US009210994B2

(12) United States Patent
Brown et al.

(10) Patent No.: US 9,210,994 B2
(45) **Date of Patent: *Dec. 15, 2015**

(54) WATER REMOVING HAIR BRUSH

(71) Applicant: Goody Products, Inc., Atlanta, GA (US)

(72) Inventors: Roberta Celeste Brown, Atlanta, GA (US); Trent Kahute, Atlanta, GA (US)

(73) Assignee: Goody Products, Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/106,375

(22) Filed: Dec. 13, 2013

(65) Prior Publication Data

US 2014/0101879 A1 Apr. 17, 2014

Related U.S. Application Data

(63) Continuation of application No. 13/341,794, filed on Dec. 30, 2011, now Pat. No. 8,627,829.

(60) Provisional application No. 61/429,077, filed on Dec. 31, 2010.

(51) Int. Cl.
*A45D 24/16* (2006.01)
*A45D 7/02* (2006.01)
(Continued)

(52) U.S. Cl.
CPC . *A46B 9/02* (2013.01); *A46B 9/023* (2013.01); *A46B 9/06* (2013.01); *A45D 24/16* (2013.01); *A46B 5/0029* (2013.01);
(Continued)

(58) Field of Classification Search
CPC ..... A46B 9/02; A46B 9/005; A46B 9/023; A46B 9/06; A46B 9/065; A46B 2200/10; A46B 2200/006; A46B 2200/104; A46B 2200/1093; A46B 2200/405; A46B 5/0029; A45D 24/16; A45D 24/24; A45D 2200/1009; A45D 2200/1018; A45D 2200/1063; A46D 1/0207; A46D 1/1006; A46D 1/023
USPC ..... 132/110, 136, 129, 126, 219, 120, 132/111–116, 107–109, 148, 150, 212, 121, 132/122, 125, 141, 142, 155, 162, 163; 15/104.94, 104.93, 160, 114, 106, 107, 15/110, 207.2, 208, 209.1, 210.1, 229.11, 15/229.12, 229.13, 244.1, 244.2, 244.3, 15/244.4, 143.1, 187; 401/291; 428/36.1, 428/36.5; 119/600, 602, 611, 612, 613, 119/615, 618, 619, 620, 621, 625, 664
See application file for complete search history.

(56) References Cited

U.S. PATENT DOCUMENTS 633,457 A * 9/1899 Hotze ..... 132/111
756,222 A * 4/1904 Evans ..... 15/117
(Continued)

FOREIGN PATENT DOCUMENTS

EP 0461553 A1 12/1991
EP 0497080 A1 8/1992
(Continued)

*Primary Examiner* — Vanitha Elgart
(74) *Attorney, Agent, or Firm* — Sutherland Asbill & Brennan LLP

(57) ABSTRACT

A hair brush includes a body having a head and a plurality of bristles carried by the head. The plurality of bristles protrudes relative to the head. A microfiber fabric material is carried by part of the body and is water absorbent. A portion of the microfiber fabric material is positioned near the plurality of bristles.

21 Claims, 17 Drawing Sheets

(51) Int. Cl.
*A46B 9/02* (2006.01)
*A46B 9/06* (2006.01)
*A46B 5/00* (2006.01)
*A46D 1/00* (2006.01)

(52) U.S. Cl.
CPC ..... *A46B 2200/405* (2013.01); *A46D 1/023* (2013.01); *A46D 1/0207* (2013.01)

(56) References Cited

U.S. PATENT DOCUMENTS 807,127 A 12/1905 Powers
1,039,982 A * 10/1912 Maley ..... 132/110
1,794,754 A 3/1931 Evangeline
1,833,293 A * 11/1931 Laguionie ..... 132/111
2,343,782 A 3/1944 Herman
2,674,758 A 4/1954 Fay
2,699,173 A 1/1955 Grace
2,946,074 A 7/1960 Caldwell
3,199,139 A 8/1965 Vallis
3,459,199 A 8/1969 Connell
4,076,032 A 2/1978 Misercola
4,226,251 A 10/1980 Wall
4,420,853 A 12/1983 Gilman et al.
4,421,129 A 12/1983 Wingard
4,423,531 A 1/1984 Wall
4,500,939 A 2/1985 Gueret
4,566,473 A 1/1986 Hyman
4,619,012 A 10/1986 Wachtel
4,830,674 A 5/1989 Kaufman
4,837,079 A 6/1989 Quantrille et al.
4,856,541 A 8/1989 Kellett et al.
4,932,425 A 6/1990 Chen
4,988,228 A 1/1991 Yeh
5,002,075 A 3/1991 Kellett et al.
5,017,036 A 5/1991 Vidovic
5,062,435 A 11/1991 Ohtsuka
5,077,914 A 1/1992 Yamamoto
5,148,571 A 9/1992 Brazis et al.
5,261,426 A 11/1993 Kellett et al.
5,301,695 A 4/1994 Wong
5,327,611 A 7/1994 Balster et al.
5,343,880 A * 9/1994 McKay ..... 132/116
5,896,614 A 4/1999 Flewitt
6,158,442 A 12/2000 Piatetsky
6,276,367 B1 8/2001 Piatetsky
6,692,505 B1 2/2004 Maier et al.
6,810,553 B1 11/2004 Otsuji et al.
6,915,807 B2 7/2005 Choi
6,928,688 B2 * 8/2005 Nam ..... 15/225
7,195,814 B2 3/2007 Ista et al.
7,198,048 B2 4/2007 Johnson
7,198,050 B2 4/2007 Gopou et al.
7,310,849 B2 12/2007 White et al.
7,322,364 B2 1/2008 Hurwitz
7,461,659 B2 12/2008 Glynn, Jr. et al.
7,610,647 B2 11/2009 Morgan et al.
7,694,687 B2 4/2010 Hurwitz
7,845,360 B2 12/2010 Walters et al.
8,042,216 B2 10/2011 Jochim et al.
8,336,156 B1 * 12/2012 Shimazu ..... 15/211
8,595,885 B1 * 12/2013 Weinstein ..... 15/160
2004/0065337 A1 4/2004 Wang
2004/0237236 A1 12/2004 Gavney, Jr.
2005/0060829 A1 * 3/2005 Silvers et al. ..... 15/230
2005/0066464 A1 3/2005 McKay
2005/0081875 A1 4/2005 Wang
2005/0198757 A1 9/2005 Gavney, Jr. et al.
2006/0026783 A1 2/2006 McKay
2007/0079842 A1 4/2007 Glynn, Jr. et al.
2007/0144451 A1 6/2007 Hurwitz
2008/0052844 A1 * 3/2008 McKay ..... 15/22.1
2008/0078043 A1 * 4/2008 McKay ..... 15/114
2008/0098546 A1 5/2008 Warmka et al.
2008/0098547 A1 5/2008 McKey
2008/0148504 A1 6/2008 Kuo
2008/0149124 A1 * 6/2008 McKay ..... 132/116
2009/0094772 A1 4/2009 Lee et al.
2009/0101160 A1 4/2009 Ruckart
2009/0165230 A1 7/2009 Tsuchiya et al.
2010/0116291 A1 * 5/2010 Triulzi ..... 134/18
2010/0132625 A1 6/2010 Dionne
2011/0119850 A1 5/2011 Mallory et al.
2011/0184499 A1 * 7/2011 Radi ..... 607/88
2011/0197917 A1 * 8/2011 Koptis et al. ..... 134/6
2011/0239390 A1 10/2011 Park
2011/0239394 A1 10/2011 Pisacane et al.
2011/0302733 A1 12/2011 Yuan
2012/0042467 A1 * 2/2012 Mandhai et al. ..... 15/209.1
2012/0096662 A1 * 4/2012 Uchiyama et al. ..... 15/160
2012/0110765 A1 5/2012 Lin
2012/0124771 A1 * 5/2012 Gooden et al. ..... 15/344
2012/0151699 A1 6/2012 Gavney, Jr. et al.
2014/0245552 A1 * 9/2014 Sharifi, Nima ..... 15/104.93
2015/0135455 A1 * 5/2015 Reusche et al. ..... 15/160

FOREIGN PATENT DOCUMENTS

EP 1272068 B1 3/2004
EP 1869992 A1 12/2007

* cited by examiner

WATER REMOVING HAIR BRUSH

RELATED APPLICATION DATA

This patent is a continuation of co-pending U.S. patent application Ser. No. 13/341,794 filed on Dec. 30, 2011, entitled "Water Removing Hair Brush", and which claimed priority benefit of prior filed U.S. provisional application Ser. No. 61/429,077 filed on Dec. 31, 2010 and entitled "Water Removing Hairstyling Implements". The entire content of these prior filed applications are hereby incorporated by reference herein.

BACKGROUND

1. Field of the Disclosure

The present invention is generally directed to hairstyling implements, and more particularly to water removing hairstyling implements, such as brushes.

2. Description of Related Art

In order to save time during hairstyling, it is desirable to reduce the amount of time it takes to dry hair, because wet hair generally cannot be styled. Towels are the most common way to absorb water from wet hair. Towels are sometimes configured as head wraps to increase the amount of contact with the hair. Nevertheless, towels typically fail to sufficiently dry hair for styling. Moreover, efforts to increase drying effects by rubbing or moving the hair with the towel can result in undesirable styling effects at a minimum, and worse, can damage the hair.

Others have tried to create products that can remove more water than a conventional towel. Combs that are otherwise traditional have been made with teeth that can move and act as a squeegee on wet hair. Other combs have added chemical additives to dissipate moisture or to break up the water molecules. Such combs have not been found to markedly remove or dissipate moisture in wet hair or to significantly reduce drying and/or styling time.

Hair brushes have been created that perform a task opposite to that of absorbing water from hair. Such hair brushes and other implements have been developed that apply or distribute oil, hair coloring agents, or conditioners to the hair and scalp. Other hair brushes have been created to absorb water, but these lack vents or a means of promoting air flow so are difficult to dry and have limited absorbing capacity. Examples of such products are disclosed in, for example, U.S. Pat. No. 7,461,659.

Other products have an absorbent capability for absorbing styling or coloring agents for applying such agents to hair. Examples of such products are disclosed in, for example, U.S. Pat. No. 5,002,075, U.S. Pat. No. 5,261,426, U.S. Pat. No. 5,301,695, U.S. Application Serial No. 2008/014504, EP 1272068, and EP 0497080.

SUMMARY

In one example according to the teachings of the present invention, a hair brush has a body with a head and has a plurality of bristles carried by and protruding relative to the head. A water absorbent material is carried by part of the body. The body has one or more vents.

In one example, the body can have a handle coupled to the head. In one example, the water absorbent material can be carried by the head.

In one example, the head can be generally rectangular in shape and can also define a cavity within the head. The one or more vents can be in communication with the cavity.

In one example, the head can be generally oval in shape and can also define a cavity within the head. The one or more vents can be in communication with the cavity In one example, the plurality of bristles can be connected to a bristle pad that is carried by the head.

In one example, a bristle pad can carry the bristles and can have a plurality of perforations formed therethrough. The plurality of bristles can be interspersed among the perforations. In one example, the perforations can be formed through a surface of the head, can be separate from the one or more vents, and/or can be one I the same as the one or more vents.

In one example, the water absorbent material can overlie a bristle pad or a surface of the head and the plurality of bristles can protrude through the water absorbent material and from the head.

In one example, the water absorbent material can have exposed edges wrapped over perimeter edges of a bristle pad and can be captured between the head and the bristle pad.

In one example, the head can be paddle shaped.

In one example, the head can have a front housing section joined to a back housing section and can have a retention plate disposed therebetween. The front housing section can have an aperture with a bristle pad and/or the water absorbent material seated therein.

In one example, a retention plate in the head can have a top section with a serrated ridge on a top surface and a support leg joined perpendicular to the top section. The water absorbent material can be anchored against the serrated ridge inside the head.

In one example, the head can have a front housing section, a back housing section, or both that include a plurality of vent holes forming the one or more vents.

In one example, the water absorbent material can be a microfiber fabric.

In one example, the water absorbent material can have a plurality of flexible rods extending from a base substrate. In one example, the base substrate and the flexible rods can be of a microfiber fabric.

In one example, the plurality of bristles can protrude through the water absorbent material. In one example, the bristles can protrude through a microfiber fabric and can be interspersed among a plurality of flexible fabric rods of the microfiber material.

In one example, the water absorbent material can be a microfiber fabric including a base substrate and fabric rods protruding therefrom generally parallel to the bristles. In one example, such fabric rods can be arranged in rows and columns of a spacing that matches a spacing of the plurality of bristles.

In one example, the water absorbent material can have antibacterial properties.

In one example, the water absorbent material can be positioned on one side of the head and the plurality of bristles can protrude from the same side of the head in a ring around a perimeter of the water absorbent material.

In one example, the water absorbent material can be a microfiber fabric with an exposed surface texture.

In one example, an exposed surface texture of the water absorbent material can be a heat stamped pattern on a microfiber fabric or other material.

In one example, an exposed surface texture of the water absorbent material can be a sewn quilted pattern on a microfiber fabric or other material.

In one example, an exposed surface texture of the water absorbent material can be formed of relatively narrow strips of a microfiber fabric or other material woven together.

In one example, the water absorbent material can be on one side of the head and the plurality of bristles can be on the same side of the head. The plurality of bristles and the water absorbent material can be arranged in alternating concentric rings.

In one example, the water absorbent material can be a microfiber fabric that overlies a bristle pad carrying the plurality of bristles. The microfiber fabric can have a thickness that is less than a length of the bristles. The bristles can protrude through the fabric.

In one example, the brush can have rows or columns of the plurality of bristles protruding from a bristle surface on the head. Elongate slots can be arranged between the rows or columns of bristles. A plurality of rods can protrude from the water absorbent material. The water absorbent material can underlie the bristle surface and the rods can protrude through the elongate slots forming alternating rows or columns of bristles and rods.

In one example, the head can be a cylinder and the body can have a handle extending from an end of the cylinder. A plurality of bristles can protrude radially outward from a surface of the cylinder.

In one example, the water absorbent material can be arranged on a surface of a cylindrical head.

In one example, the water absorbent material can spiral around an outer surface of a cylindrical head. The water absorbent material and the plurality of bristles can be arranged to form alternating spirals along a length of the cylinder.

In one example according to the teachings of the present invention, a hair brush has a body with a head and has a water absorbent material carried by the body. The water absorbent material can be a foam material.

In one example, the body can have a handle coupled to the head and the foam material can be carried on the head.

In one example, the head can be paddle shaped and the foam material can include a plurality of vanes protruding from a surface of the head.

In one example, a plurality of foam material vanes can be provided having different lengths and can protrude from a surface of the head.

In one example, the head can have one or more rows or columns of teeth or bristles arranged at or near perimeter edges of the head. The foam material can be at least partially surrounded by the rows or columns of teeth and can protrude from the same side of the head as the rows or columns of teeth.

In one example, the head can be paddle shaped and the foam material can be in the form of serpentine waves or loops arranged in aligned rows or columns on a side of the head.

In one example, the foam material can be arranged having two or more spaced apart ridges protruding from a surface of the head. A plurality of bristles can be arranged alternating with the two or more spaced apart ridges and protruding from the surface of the head.

In one example, the foam material can be arranged in multiple ridges protruding from a surface of the head. A plurality of bristles can be arranged in alternating rows or columns on and protruding from the surface of the head.

In one example, the head can be a cylinder and can have a handle extending from an end of the cylinder. The foam material can protrude from an outer surface of the cylinder.

In one example, the hair brush can have a plurality of bristle cores protruding from the head and each can be covered by or coated with the foam material.

In one example, the head can have a back side and a recess formed in the back side and can have has a front side. A plurality of perforations can be formed through the head within the recess. The foam material can have a block seated in the recess and can have a plurality if bristles protruding from the block and extending through corresponding ones of the plurality of perforations to protrude from the front side of the head.

In one example, the body of the hair brush can have a support plate with a bristle face on one side, a bridge spaced from the support plate on the side opposite the bristle face, a core of the foam material captured between the bridge and the support plate, and a plurality of bristles protruding from the bristle face. The plurality of bristles each can have a center core of a non-absorbent material covered by or coated with the foam material.

In one example, the body of the hair brush can have a support plate with a bristle face on one side, a bridge spaced from the support plate on the side opposite the bristle face. The bridge can have an arc shape and connect to opposed ends of the support plate. A core of the foam material can be captured between the bridge and the support plate.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

In view of the foregoing, there exists a need for a hairstyling implement that can aid in accelerating hair drying during styling. The hairstyling brushes disclosed herein are well suited for aiding in the hair drying process. The disclosed hair brushes solve or improve upon one or more of the above-noted and/or other problems and disadvantages with prior known hair brushes. The disclosed styling tools remove water by employing absorbent materials and cause no damage to hair.

Figure 1:
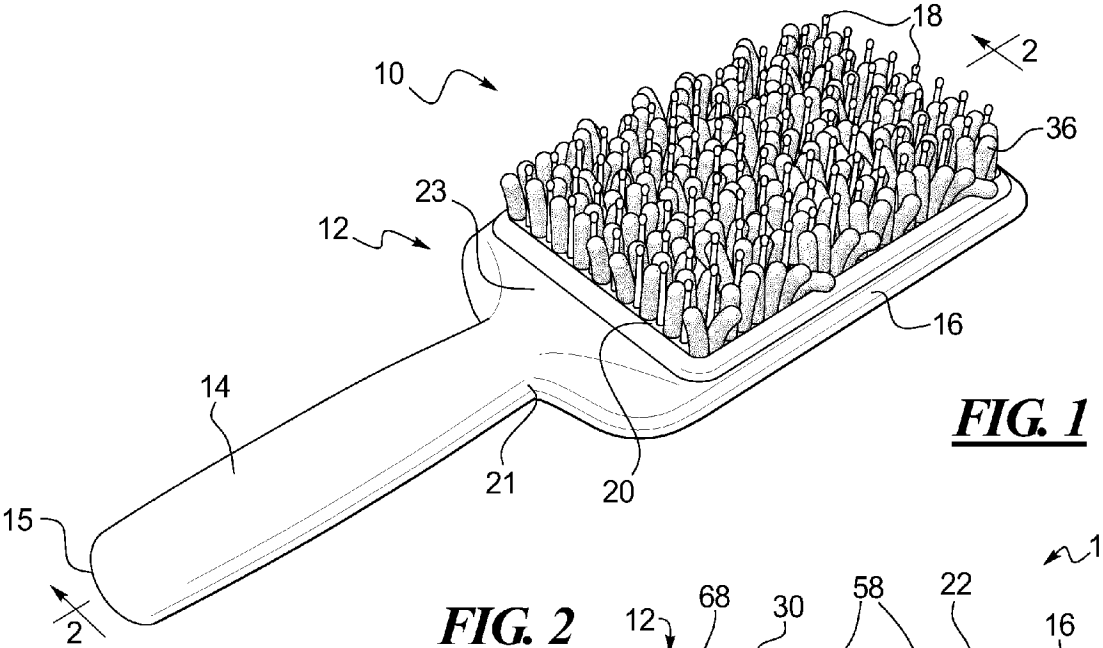
FIG. 1 shows a perspective view of one example of a hair brush according to the teachings of the present invention.

Turning now to the drawings, FIGS. 1-7 show one example of a hairstyling implement or hair brush 10 according to the present disclosure. The hair brush 10, as shown in FIG. 1, includes a body 12 with a handle 14 and a head 16. The hair brush 10 also has a plurality of bristles 18 and a water absorbent material 20 to absorb water from wet hair. The handle 14 extends from one end 15 of the head 16. The head 16 in this example is paddle-shaped and is somewhat rectangular, although other head shapes may be used.

The hair brush 10 is for use as a hairstyling implement that also can dry hair simultaneously as the hair is brushed and styled. The water absorbent material 20 on the brush head 16 absorbs and removes water from the hair during styling. The water absorbent material 20 is disposed proximal to the bristles 18. In this example of FIGS. 1-7, the bristles 18 extend from one side of the head 16 and through the water absorbent material. A user need not alter the usual way that they style or brush their hair with such a brush. Drawing the brush over wet hair causes strands of hair to be separated by the bristles. Thus, wet strands of hair will contact the water absorbent material 20, which will absorb and remove water from the hair, thereby reducing the amount of time it takes to dry and style hair.

Figure 2:
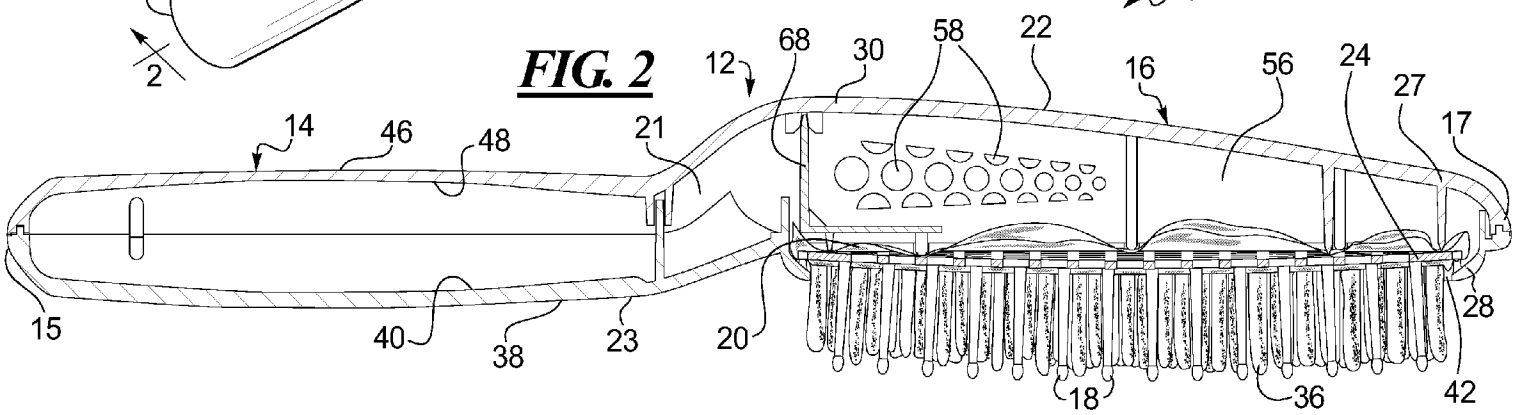
FIG. 2 shows a lengthwise cross section taken along line X-X of the hair brush of FIG. 1.

The handle 14 in this example has a shape that transitions to a shape of the head 16 through a neck 21. The relatively narrow width of the handle 14 widens at the neck 21 to match the width of the head 16. As shown in the cross section of FIG. 2, the head 16 has a depth. The depth of the head 16 can have a tapered profile, being somewhat thicker at the neck 21 and handle end 15 and relatively thinner at a top end 17 of the head 16. As shown in FIG. 2, the neck 21 profile has a step or is angled toward a back side 22 of the hair brush 10.

As shown in FIG. 2, the hair brush 10 further includes a bristle pad 24 on and connected to a front side of the head 16. The bristle pad 24 has a plurality of perforations 26 and supports the plurality of bristles 18. The water absorbent material 20 overlies the bristle pad 24 in this example. The water absorbent material 20 is disposed adjacent to the bristle pad 24 with the plurality of bristles 18 protruding fully therethrough.

Figure 3:
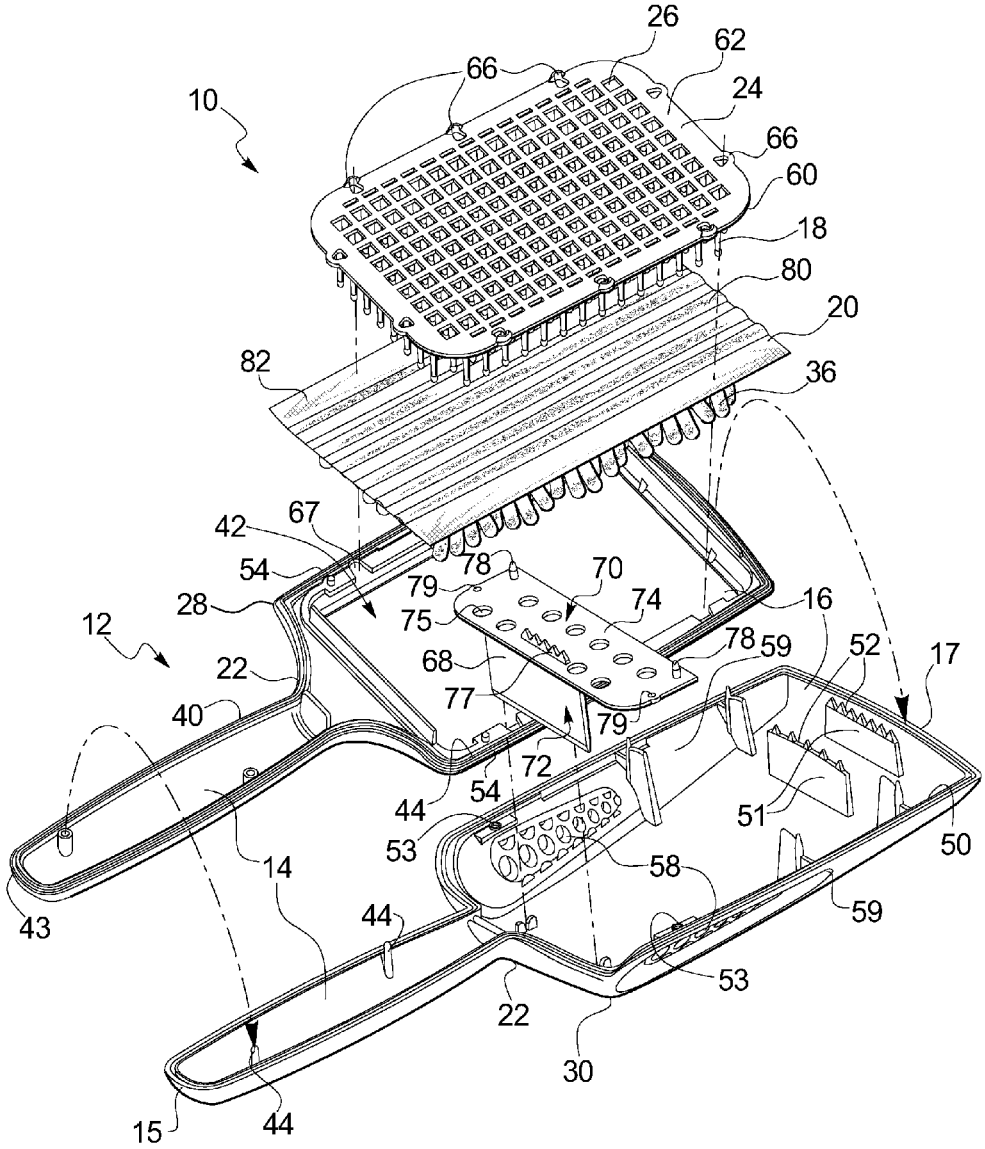
FIG. 3 shows an exploded view of the hair brush of FIG. 1.
Figure 4:
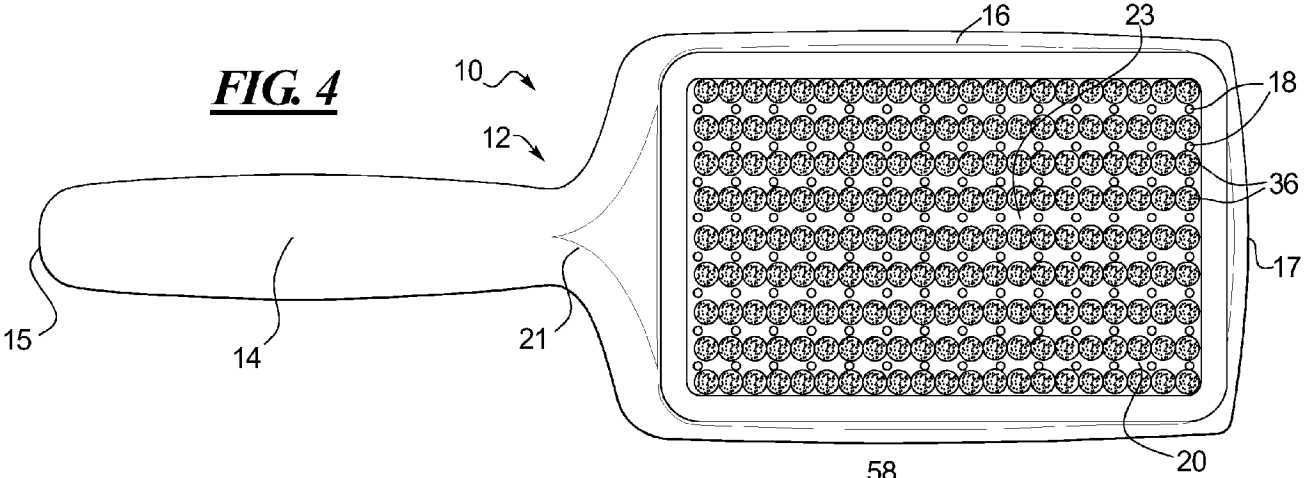
FIG. 4 shows a front view of the hair brush of FIG. 1.
Figure 5:
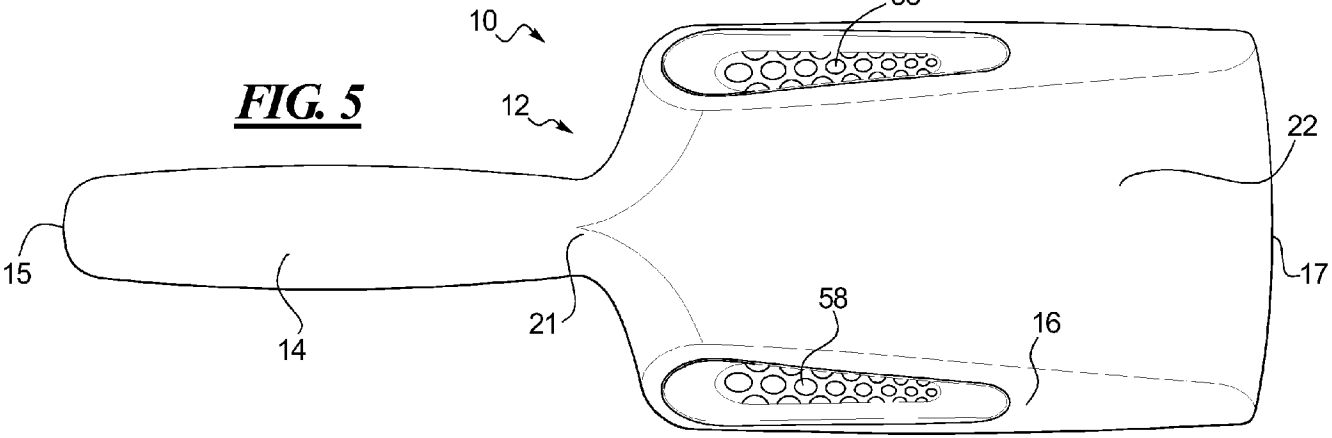
FIG. 5 shows a back view of the hair brush of FIG. 1.

The brush body 12 may be constructed from one or more pieces. In this example, the brush body 12 has two pieces as shown in FIG. 3, including a front housing section 28 and a back housing section 30. The front housing section 28 includes a handle portion defining part of the handle 14 and a head portion defining part of the head 16. The front housing section 28 has an outside surface 38 and an inside surface 40 and has an aperture 42 in the head portion to receive the bristle pad 24. The front housing section 28 includes a mating surface 44 at an edge between the outside surface 38 and the inside surface 40. The mating surface 44 is located around a perimeter of the front housing section 28.

The back housing section 30 also includes a handle portion defining part of the handle 14 and a head portion defining part of the head 16. The back housing section 30 has an outside surface 46 and inside surface 48. The back housing section 30 also includes a mating surface 50 at an edge around a perimeter of the back housing section 30 between the outside surface 46 and the inside surface 48. The inside surface 48 can also include supports 51 protruding forward therefrom to support the bristle pad 24. The supports 51 are in the form of spaced apart thin walls that project from the inside surface 48 at an angle approximately normal to the longitudinal axis of the brush body 12. The supports 51 do not extend completely laterally across a width of the brush body 12. Two such supports 51 are shown, but the number, shape, orientation, and position of such supports can vary. The supports 51 in this example have a notched or serrated free edge 52 to aid in positionally retaining the water absorbent material 20 during use.

The mating surface 44 on the front housing section 28 is adapted to engage the mating surface 50 of the back housing section 30 when the body 12 is assembled. As shown in the exploded view of FIG. 3, the front housing section 28 has positioning elements or guide holes 53 and the back housing 30 has corresponding positioning elements or guide pins 54. The guide holes 53 are adapted to receive the guide pins 54 to properly align the two housing sections when assembled. The guide holes 53 and the guide pins 54 may be located inward from the perimeter of the back housing section 30 and front housing section 28 respectively. The relative positions and locations of the guide holes and guide pins on the front or back housing sections may be reversed.

A cavity 56 under the bristle pad 24 is defined by the assembled head portions of the front housing section 28 and the back housing section 30. The back housing section 30 has a plurality of vent perforations 58 providing openings to the cavity 56 to provide for air flow into, through, and out of the cavity 56. In the present example, the vent perforations 58 are arranged on lateral side walls 59 of the back housing section 30. The number and arrangement of the vent perforations can vary in location and can be uniform, random, and/or can vary in size.

The bristle pad 24, as shown in FIGS. 2 and 3, is formed of a strong yet flexible material such as nylon. The bristle pad 24 also defines a front side of the cavity 56 by covering the aperture 42 in the head portion of the front housing section 28. The bristle pad 24 includes a front surface 60 and a back surface 62 and is generally planar. The bristle pad 24 supports the plurality of bristles 18 in a geometric grid of rows and columns. In this example, the bristles 18 are arranged on the front surface 60 of the bristle pad 24. The plurality of bristles 18 extend outward from and generally perpendicular to the front surface 60 of the bristle pad 24 in a direction opposite the back surface 62. The plurality of bristles 18 may be integrally formed or molded with the bristle pad 24 from the same flexible material.

The perforations 26 in the bristle pad 24 are arranged in rows and columns among and between each of the bristles 18. In this example, the perforations 26 have a square shape. The perforations 26 form a grid-like mesh with cross points and each of the bristles 18 is integrally molded on the bristle pad at the cross points of the grid. Other arrangements, shapes and sizes of perforations 26 can be used and remain within the teachings of the present invention. The perforations 26 allow additional air to flow into, through, and out of the cavity 56 through the bristle pad 24. Air can also flow through the cavity via the vent perforations 58 in the back housing section 30.

The bristle pad 24 can have a plurality of interlock projections 66 arranged around and protruding radially outward from its perimeter. The interlock projections 66 can have a predetermined shape protruding outward from the perimeter of the bristle pad 24. The bristle pad projections 66 can interlock with and seat in corresponding interlock notches 67 adjacent the aperture on the front inside surface 40 of the front housing section 28. The projections 66 and notches 67 align and position the bristle pad 24 during assembly. Other alignment pins, holes, mechanisms, etc. could also be used in place of the projections and notches.

Also shown in FIGS. 2 and 3, the hair brush 10 includes a retention plate 68 in the cavity of the head 16 to assist in retaining the bristle pad 24 and the absorbent material 20 in place. The retention plate 68 has a top section 70 and a leg 72. The leg 72 extends from an underside of the top section 70 and is arranged perpendicular to the top section 70. The top section 70 of the retention plate 68 has a top surface 74. A notched or serrated ridge 77 is arranged on the top surface 74 of the top section 70. The top section 70 can also have a plurality of perforations 80 so as to enhance air flow through the cavity 56 during use of the hair brush 10. The retention plate 68 seats within the cavity 56 with the leg 72 oriented perpendicular to the inside surface 48 of the back housing 30. The top such section 70 of the retention plate 68 also has guide pins 78 and guide holes 79 in order to be retained securely in place within the cavity 56.

The hair brush 10 of FIGS. 1-7 is only one example of a hair brush configuration that can be used according to the present invention. The shape of the hair brush 10 is not necessarily limited to a paddle style brush as shown, with a somewhat rectangular head, but may include other shapes of brush heads including, but not limited to, other examples disclosed herein.

Figure 6:
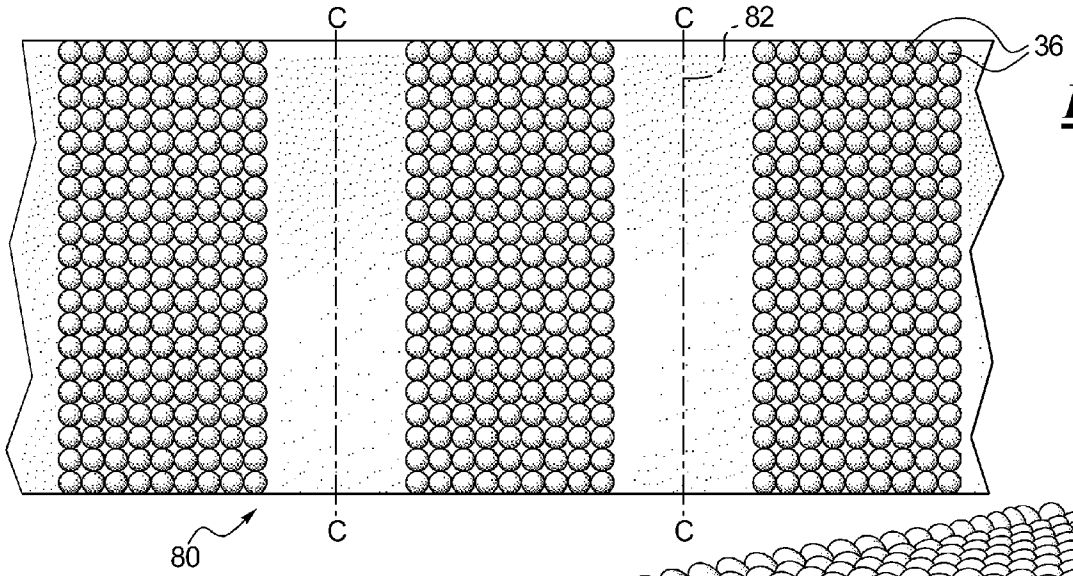
FIG. 6 shows a portion of a manufactured blank of absorbent material for the hair brush of FIG. 1.
Figure 7:
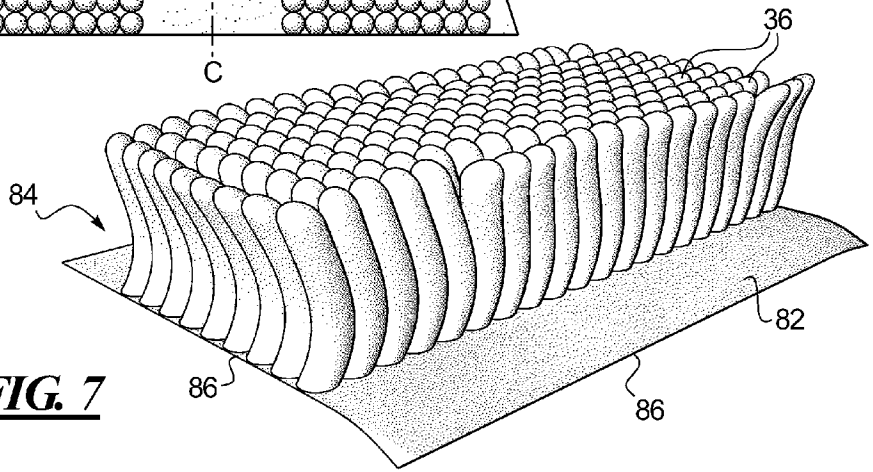
FIG. 7 shows a perspective view of a segment of the absorbent material of FIG. 1.

The water absorbent material 20 in one example can be a microfiber fabric 80. As shown in FIGS. 6 and 7, the microfiber fabric 80 have a continuous base substrate 82 and rows and columns of flexible fabric rods 36 formed extending from the base substrate. The microfiber fabric 80 can be manufactured in a sheet or blank of multiple uncut microfiber fabric segments. The flexible fabric rods 36 can be a chenille, i.e. relatively short lengths of soft, tufted cord, in one example, and can be woven of the microfiber material. The rows and columns of fabric rods 36 are manufactured on the base substrate 82. The columns of fabric rods 80 can have the same width as a width of the arrangement of the plurality of bristles 18 on the bristle pad 24. The columns of fabric rods 36 can be spaced apart on the continuous blank or sheet by base substrate sections having no fabric rods thereon. This can ease the process of cutting the microfiber fabric sheet into appropriately sized segments 84, as shown in FIG. 7, and to allow for assembly as described below. The sheet or blank can have a width designed to precisely fit a length or width of the bristle pad 24. The spacing of the segments of the fabric rods can be designed to fit the length or width. The blanks or sheets of the fabric can then be cut along cut lines C-C crosswise, for example, to fit the width of the bristle pad 24 with essentially no waste. Assembly of the brush 10 may then necessitate that only the base substrate 82 is wrapped around sides of the bristle pad 24 and any fabric rods remain free along sides of the head 16.

The microfiber fabric 80 can alternatively be manufactured in blank form having a continuous substrate and in which rows and columns of the flexible fabric rods are intermittently omitted at intervals corresponding to a length and width of a bristle pad. When the microfiber fabric is thus manufactured in sheets of multiple uncut segments, once cut the base substrate material can be wrapped around both of the sides and the ends of the bristle pad 24.

The microfiber fabric 80 can have antibacterial properties. An antimicrobial additive, e.g. triclosan or a suitable alternative can be applied to the microfiber fabric or other water absorbent material that may be used in the making of the disclosed hair brushes.

During assembly, blank segments 84 of the microfiber fabric 80 are first cut to the appropriate size from the larger sheets. Each cut blank segment 84 of the microfiber fabric 80 is then placed over a bristle pad 24. The plurality of bristles 18 can then penetrate and protrude through the base substrate 82 can be the microfiber fabric. As a result, the fabric rods 36 on the substrate 82 are arranged among and between the bristles 18. Edges 86, either cut sides or selvedges, of the microfiber fabric base substrate 82 are wrapped around and overlap edges of the bristle pad 24. Together the bristle pad 24 and the microfiber fabric 80 are inserted into the aperture 42 in the front housing 28. The retention plate 34 is placed between the back surface 62 of the bristle pad 24 and the inside surface 48 of the back housing section 30. The edges 86 of the microfiber fabric blank segment 84 that is wrapped around the bristle pad 24 will be borne against the retention plate 34 and the serrated edge 52 of the supports 51 will anchor the fabric inside the cavity 56 of the head 16 of the hair brush 10.

During assembly of the brush body 12, the guide pins 54 allow the front housing section 28, and the back housing section 30 to be fitted together precisely with the microfiber fabric blank segment 84 and bristle pad 24 in place and captured therebetween. When the mating surfaces 44, 50 of the front and back housing sections 28, 30 are connected, the cavity 56 is formed between the inside surface 48 of the back housing section 30 and the inside surface 40 of the front housing section 28. The cavity 56 can extend into the handle 14 of the brush body 12, as in the example of FIGS. 1-7.

The brush body 12 can be formed in other different ways and have a variety of different constructions with additional and or alternate features. In the present example, the front housing section 28 and back housing section 30 can be joined by sonic welding. Alternatively, the front housing section and back housing section may have complementary features that snap together. In another alternative, the front housing section and the back housing section may be joined with an adhesive or with removable fasteners. In another alternative, the hair brush body may be constructed from a single unitary piece.

The hair brush 10 can be used in styling hair in the same manner as a typical hair brush. The water absorbent material can draw water out of wet hair and more quickly dry the hair than a typical hair brush alone. Merely brushing wet hair with the hair brush 10 can reduce drying and styling time because the water absorbent material draws water from the hair more quickly than evaporation alone.

Another advantage of the hair brush 10 over a typical hair brush is that, in addition to aiding in creating a hairstyle, it also can reduce the time to dry hair during styling when used with a blow dryer for hair. When used in conjunction with a typical blow dryer, water is drawn out of the hair by the absorbent material and warm air is forced over and through the hair. The warm air can then pass through the perforated bristle pad, into the cavity and out the vents in the body, or vice versa. Such air flow can continuously evaporate water from the water absorbent material simultaneous with the evaporating water from the hair. This allows the water absorbent material to continue to draw water from the hair, further reducing drying time. The variety of disclosed brushes can allow a user to complete virtually any hair styling steps that would otherwise be completed using a brush of comparable shape but with no water absorbent material. Thus, a user need not change brushes during styling and will require no learning curve to style with one of the disclosed brushes.

Figure 8:
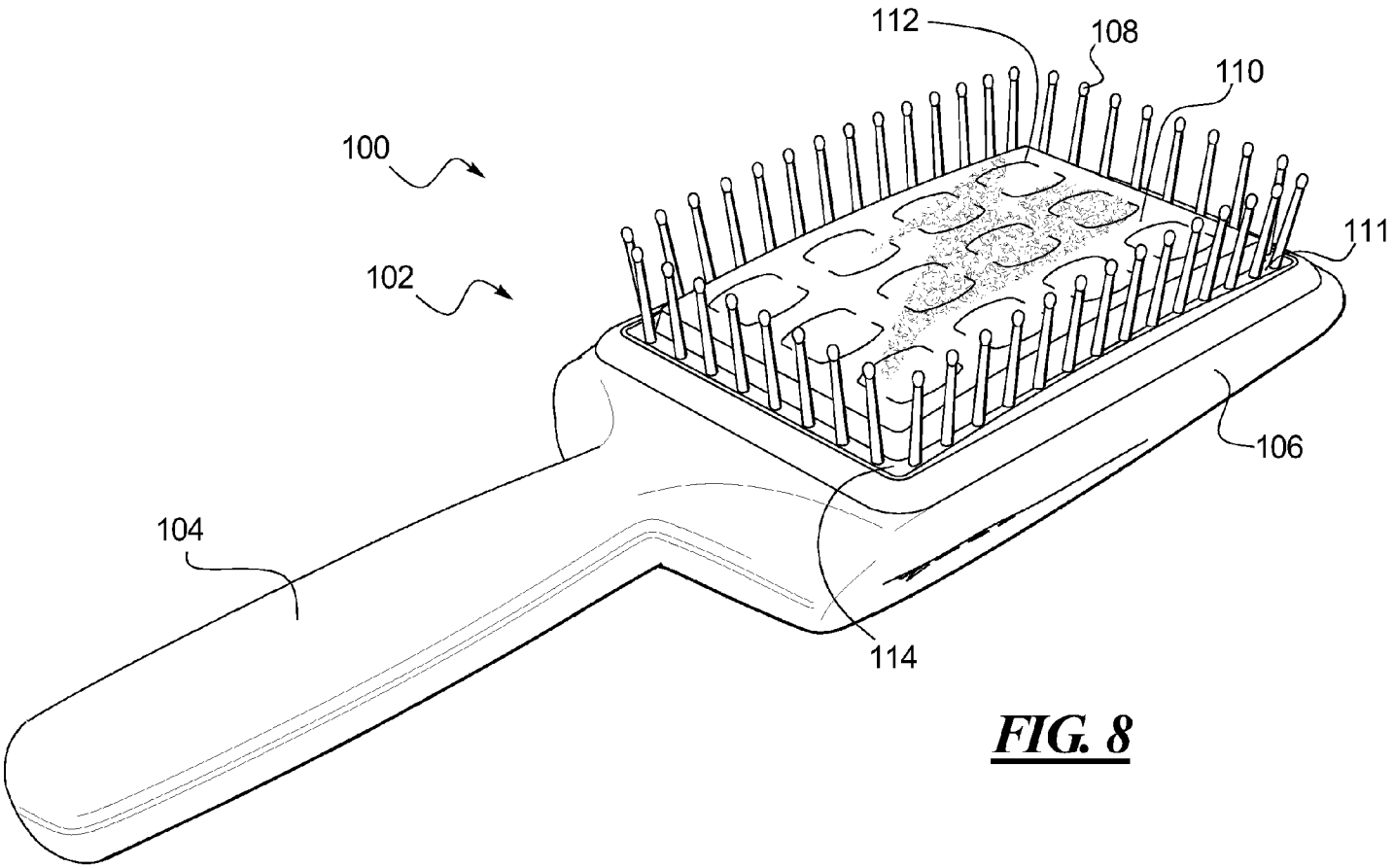
FIG. 8 shows a perspective view of another example of a hair brush according to the teachings of the present invention.

In another example as illustrated in FIG. 8, a hair brush 100 has a body 102 with a handle 104 joined to a head 106. The head 106 in this example has a somewhat flattened rectangular paddle style shape, similar to head 16. The head 106 has rounded corners and has a depth or thickness. The head 106 can have an aperture in a front of the head 106, similar to the aperture 42. The head 106 carries a plurality of bristles 108 and an absorbent material 110 that seat in the aperture 107. The plurality of bristles 108 in this example is in a ring arranged adjacent and around a perimeter of the water absorbent material 110. The water absorbent material is positioned entirely within the bristle ring, in contrast to example above in which the bristles protrude through a microfiber fabric. The bristles 108 can be integrally molded with a base or bristle pad 114 or can be individually mounted on the base. The water absorbent material 110 can be provided as an absorbent block of material or as a microfiber fabric.

In the example of FIG. 8, the exposed surface 111 of the microfiber fabric can have a texture 112. The texture 112 can be applied, added, or created on the microfiber fabric 111 in a number of different ways. The texture 112 can be applied by heat stamping or sewing the texture onto the microfiber fabric surface 111. In another alternative, the texture 112 of the microfiber fabric can be applied by weaving relatively narrow strips of microfiber fabric together to form larger sheets of fabric having a relatively greater thickness. Such a weave can increase the effective thickness of the microfiber fabric thereby increasing its absorbent characteristics. The purpose of adding texture to the absorbent material or microfiber fabric is to increase the absorbent surface area of the contact surface 111 of the water absorbent material 110.

As shown in FIG. 8 and as stated above, the plurality of bristles 108 can be supported on the bristle pad 114 that surrounds the water absorbent material. The water absorbent material can overlie a portion of the bristle pad 114. The bristle pad or base substrate 114 can be sized to fill the aperture in the head 106, can be formed of a flexible material, and can have perforations to allow air flow through a brush body cavity during hairstyling and for drying the water absorbent material afterward. The brush body 102 can be constructed in essentially the same manner as the body 12 of the brush 10, if desired.

Figure 9:
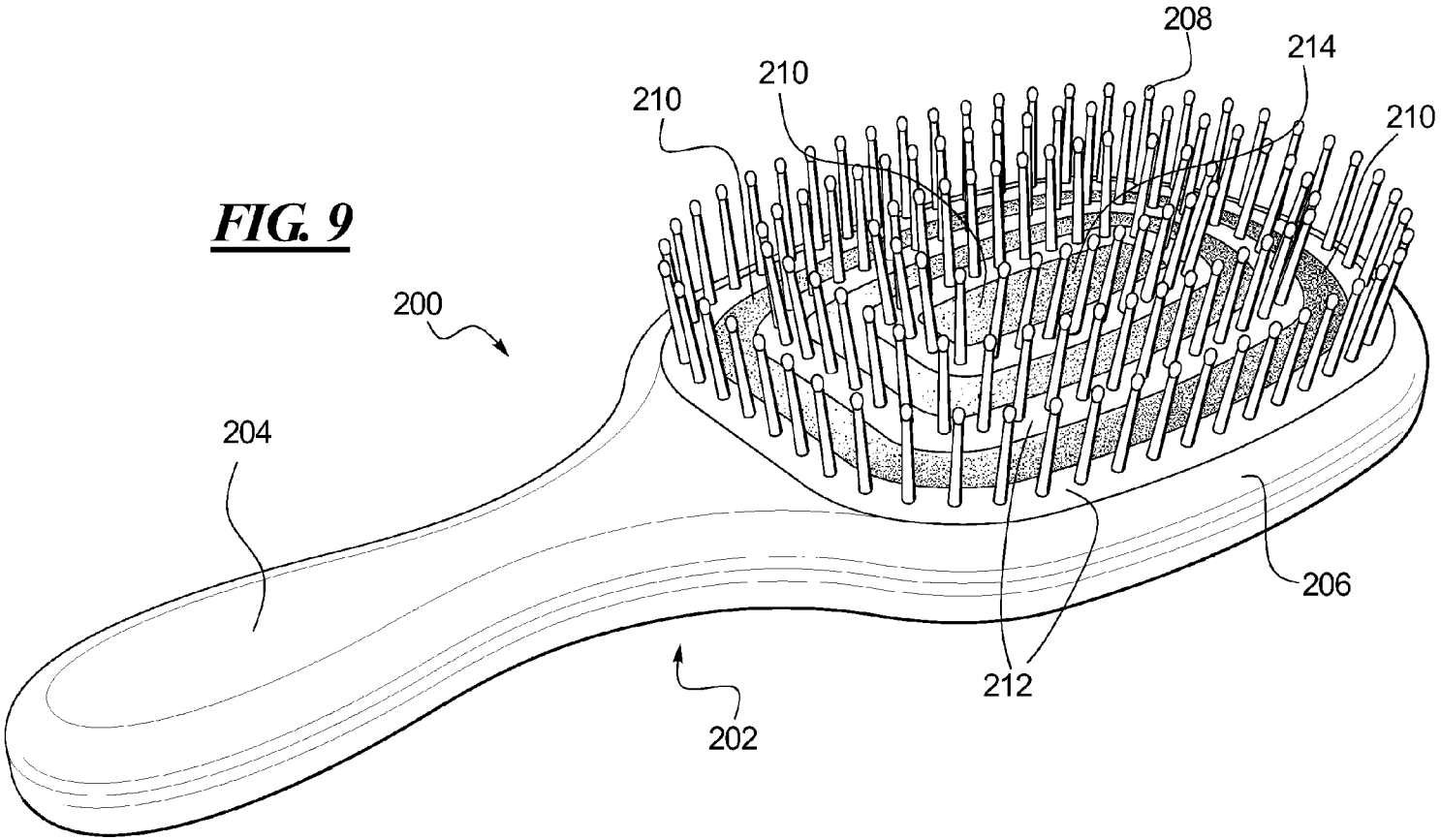
FIG. 9 shows a perspective view of another example of a hair brush according to the teachings of the present invention.

In another example as illustrated in FIG. 9, a hair brush 200 has a body 202 with a handle 204 extending from a paddle shaped head 206. The head 206 in this example has a plurality of bristles 208 and a water absorbent material 210 exposed on the same surface of the head. The bristles 208 in this example are arranged in a series of concentric rings alternating with a series of concentric rings of the absorbent material 210. The alternating rings are graduated in size, growing smaller toward a central area 214 of the head 206. In this example, the smallest ring of bristles surrounds the central area 214 covered by the water absorbent material 210. The water absorbent material 210 can be a microfiber fabric. Such a microfiber fabric in this and in other examples can have a texture, as discussed above, or can be woven in a manner similar to terrycloth as is commonly used in cotton towels. The bristles 208 can be supported on a bristle substrate or pad 212. The water absorbent material 210 or at least a portion thereof can be disposed under the bristle substrate 212 with absorbent material texture or segments protruding through the pad or substrate. Alternatively, the water absorbent material rings can each overlie the pad or substrate 212. The bristle pad or substrate 212 can have perforations to allow air flow through the brush during drying and styling of the hair. A separate support component can underlie one or both of the bristle pad 212, the water absorbent material 210, or both, though not necessary to the teachings of this or any other example.

Figure 10:
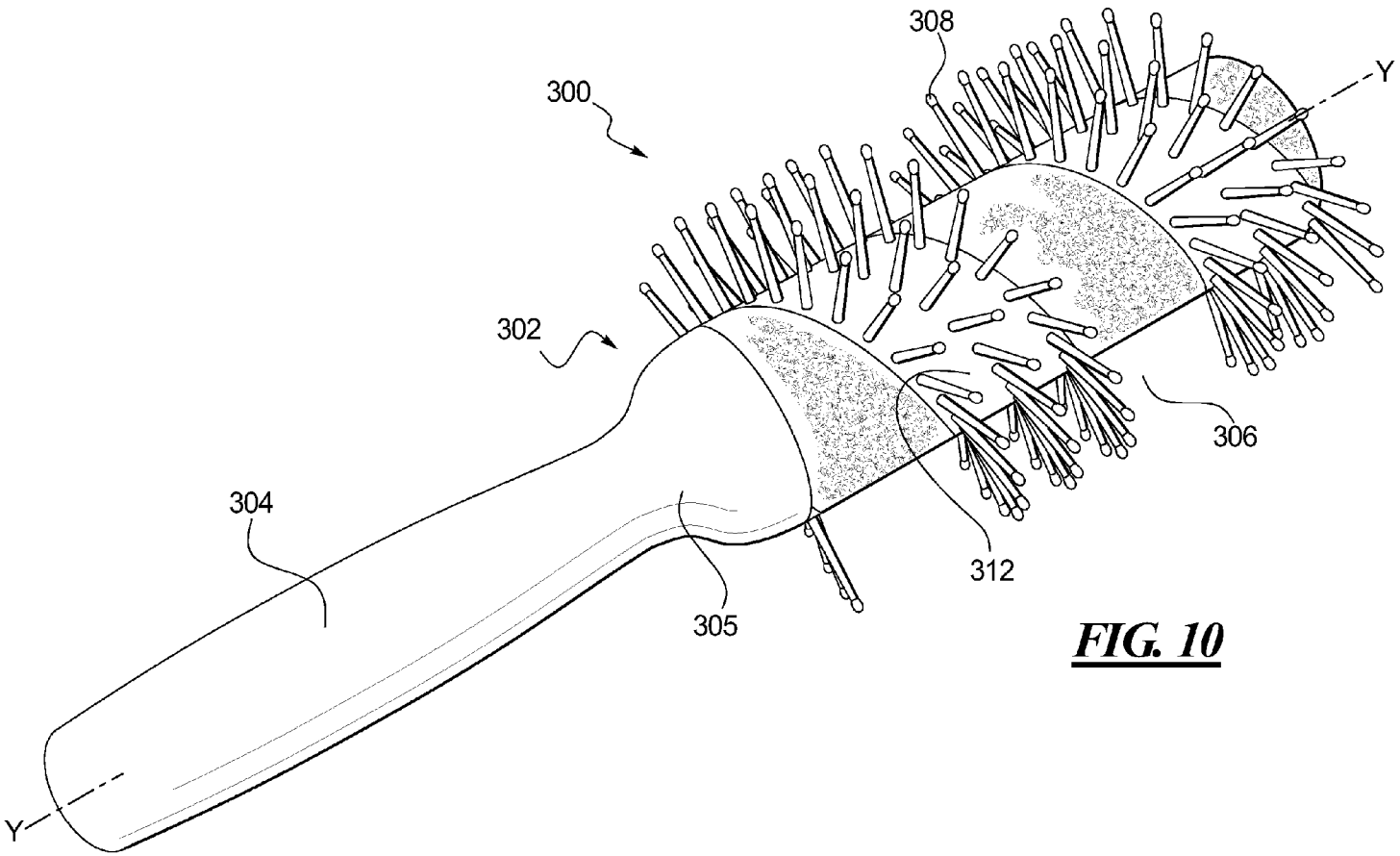
FIG. 10 shows a perspective view of another example of a hair brush according to the teachings of the present invention.

FIG. 10 shows an example of a hair brush 300 having a cylindrical head or round brush head. The hair brush 300 has a body 302 with a handle 304 extending from one end of a cylindrical head 306. The handle 304 can be shaped so as to be comfortable to hold, as can any of the other handles disclosed and described herein. The body has a neck 305 that provides for a transition from the shape and diameter of the handle 304 to the shape and diameter of the head 306. The neck 305 can be narrower in diameter than either the handle 304 or the head 306. The diameter of the cylindrical head 306 can vary based on the hairstyling effects desired. A relatively larger diameter cylindrical head is used to form larger hair curls and a relatively smaller diameter cylindrical head is used to form smaller hair curls.

In the example of FIG. 10, the head 306 is a cylinder and has a plurality of bristles 308, protruding through, mounted on or integrally molded to the outer surface of the head 306. The bristles 308 extend radially outward relative to a lengthwise axis Y-Y of the body 302. The head 306 has an absorbent material 310 mounted on another part of the head. The bristles 308 and the water absorbent material 310 can be arranged in alternating spirals or helical patterns over the length of the cylindrical shape of the head 306. When viewed from one side of the head 306, the plurality of bristles 308 and the water absorbent material 310 can appear to form spiral stripes around the head in the manner of a barber pole or a candy cane.

In the example of FIG. 10, the water absorbent material 310 can again be a microfiber fabric. The microfiber fabric can be supported and wrapped around a portion of the head 306 so as to underlie a substrate or base 312 supporting the bristles 308 on the head 306. Alternatively, the water absorbent material 310 can overlie a substrate that supports bristles, the outer surface of the brush or both. Portions of the head 306 or the base or bristle substrate 312, even between the bristles 308, can be perforated to further allow air flow through the head to reduce styling time and to aid in drying the water absorbent material 310 in between uses.

Figure 11:
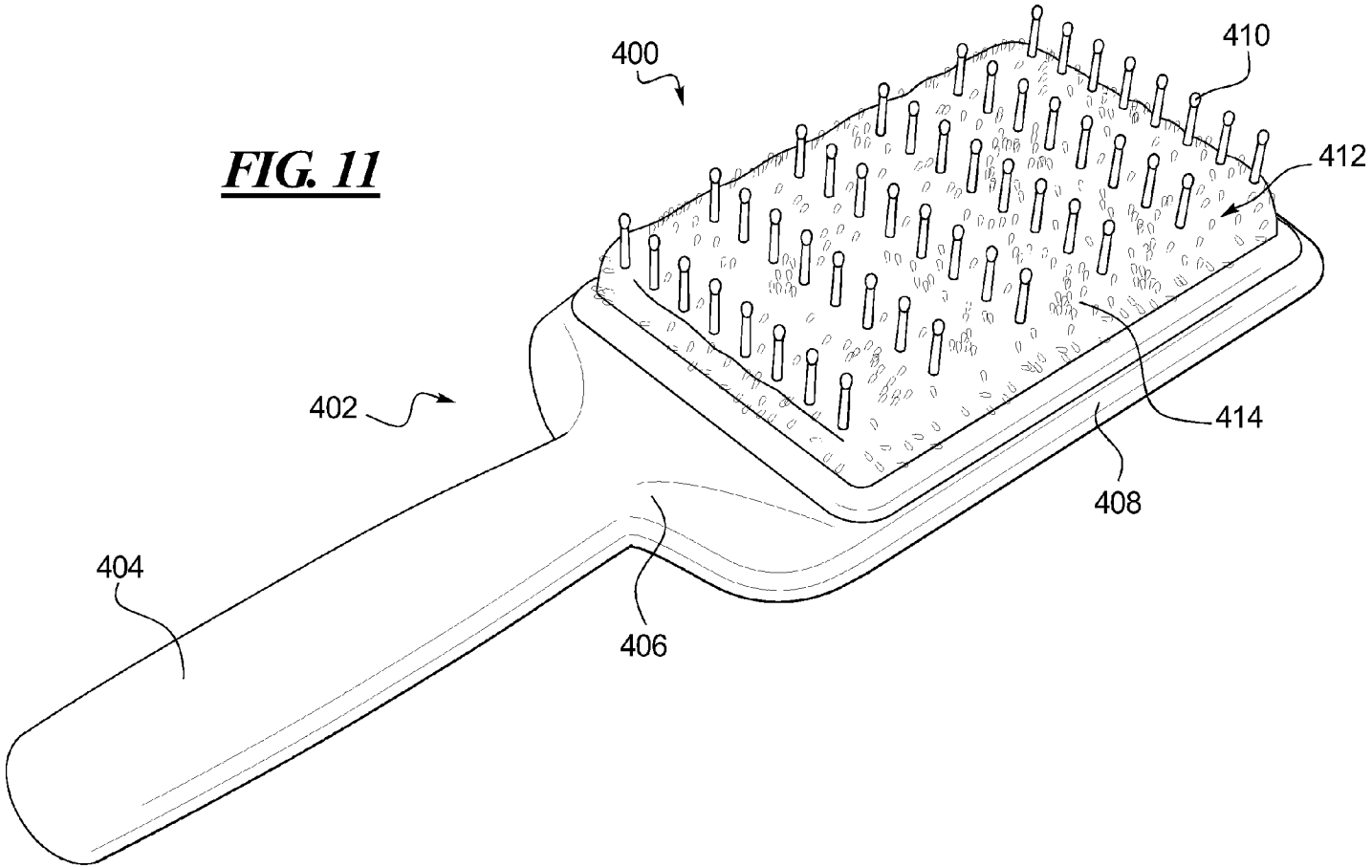
FIG. 11 shows a perspective view of another example of a hair brush according to the teachings of the present invention.

FIG. 11 shows another example of a hair brush 400 with a body 402 and a handle 404 joined by a neck 406 to a head 408. The head 408 has a plurality of bristles 410 and a water absorbent material 412 positioned on the same surface of the head. In this example, the water absorbent material does not have fabric rods as disclosed in the example of FIG. 1, but has a surface texture 414. The bristles 410 extend through the water absorbent material. The water absorbent material 412 overlies a bristle substrate, pad, or base (not shown). The water absorbent material can again be a microfiber fabric. The microfiber fabric can have a loose textured surface such as that of a terry cloth material, typically used in cotton toweling, but woven or formed of microfiber. Otherwise, the structure of the example of FIG. 11 can be similar to the example of FIG. 1. In this example, the bristles 410 are again arranged in rows and columns, though not as closely spaced.

Figure 12:
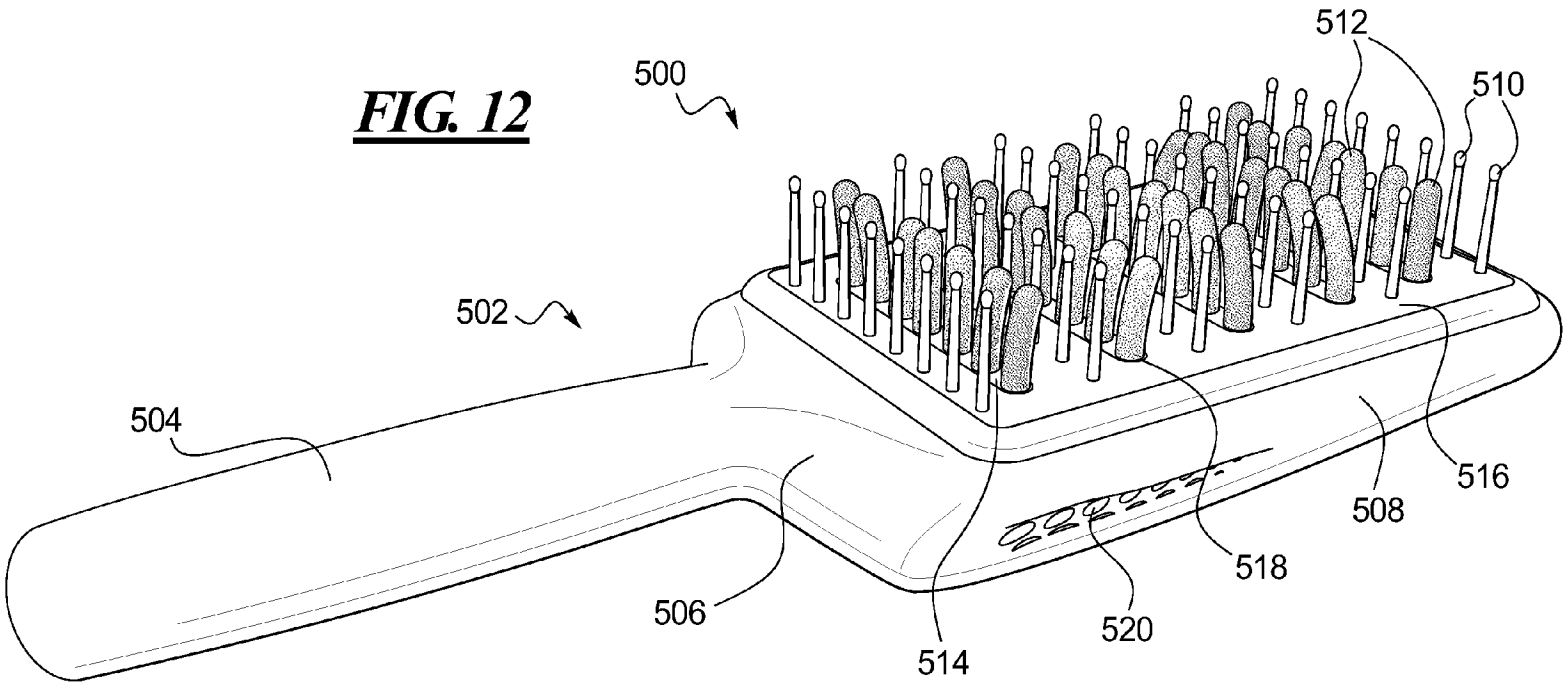
FIG. 12 shows a perspective view of another example of a hair brush according to the teachings of the present invention.

FIG. 12 shows another example of a hair brush 500 having a body 502 with a handle 504 extending from a head 506. The head 508 in this example is a somewhat flattened rectangular paddle style head similar to the example of FIG. 1. The head 508 has a plurality of bristles 510 and a water absorbent material provided by a plurality of absorbent rods 512 attached to a base substrate 514. The bristles 510 are supported by and arranged in rows and columns on a base, substrate, or bristle pad 516. The absorbent rods 512 and the base substrate 514 can be formed of a microfiber fabric. The bristle base or pad 516 can have elongate slots 518 arranged between rows or columns of the bristles 510. When assembled, the bristle base or pad 516 can overlie the base substrate 514 of the water absorbent material while allowing the rods 512 to extend through the elongate slots 518 from a back to a front between the rows or columns of bristles. The elongate slots 518 also can be configured to allow air to pass through the bristle base or pad 516 during styling. The brush body 502 can have a cavity defined within the brush body. Sides or a back of the brush body 502 can include vent holes 520 or perforations through to the cavity to allow air to flow through the brush during drying and styling, as with any of the prior examples.

Figure 13:
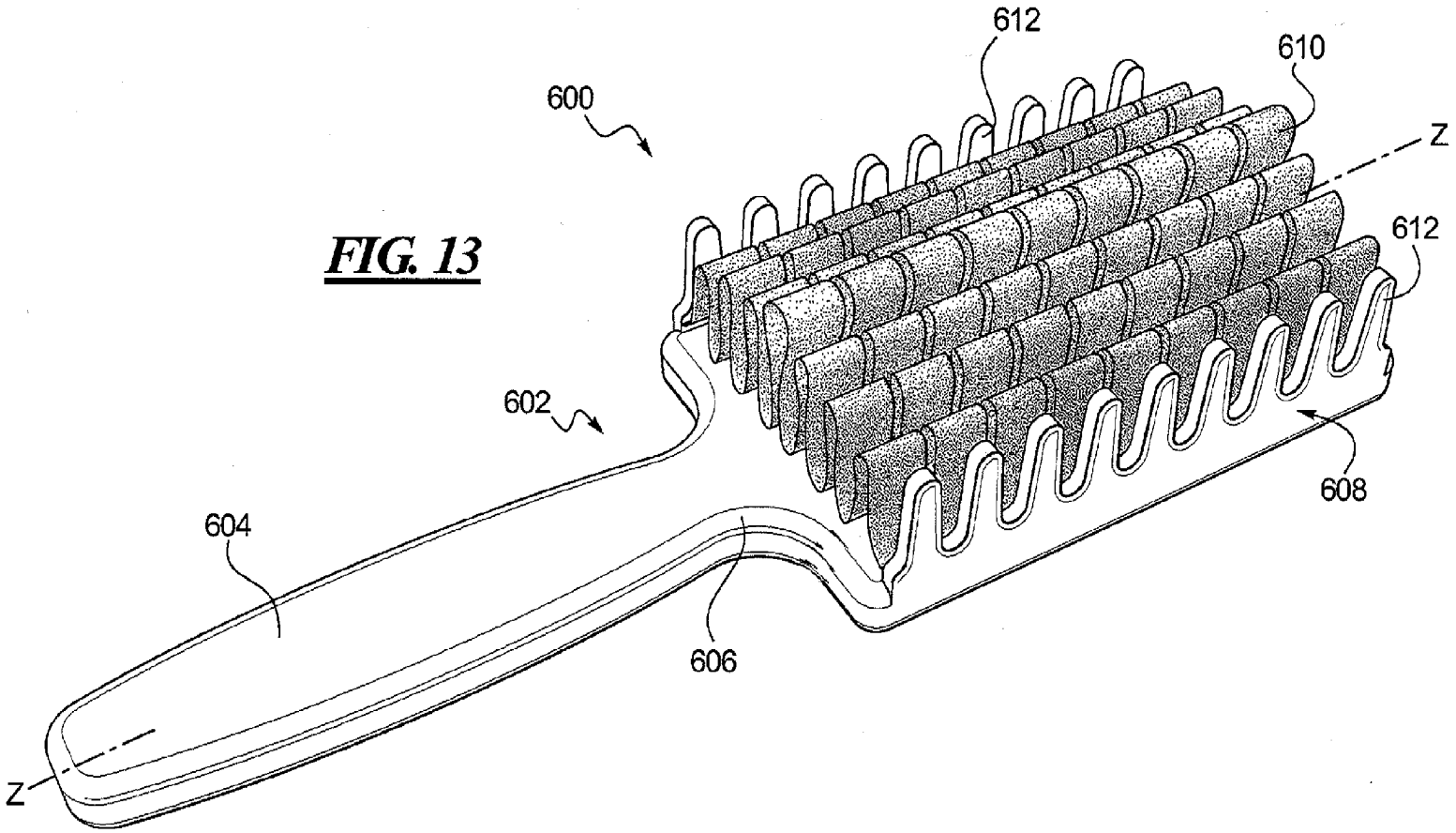
FIG. 13 shows a perspective view of another example of a hair brush according to the teachings of the present invention.
Figure 14:
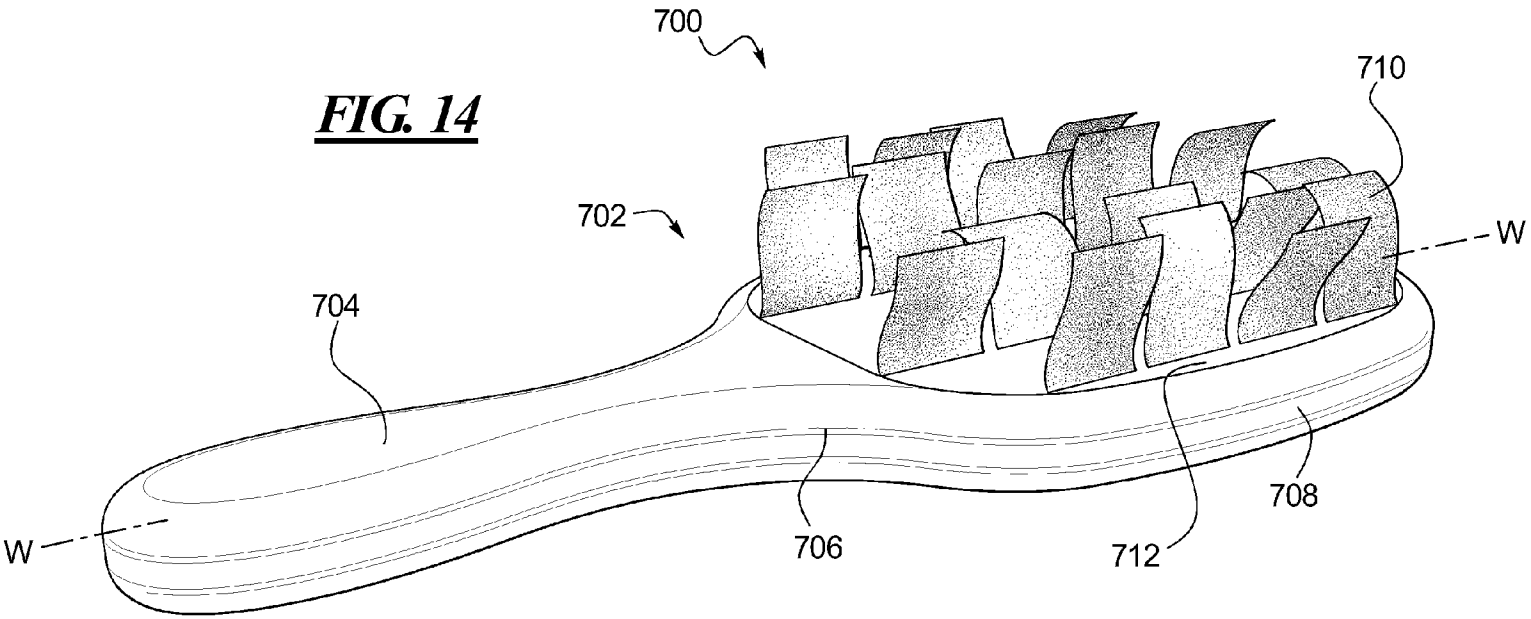
FIG. 14 shows a perspective view of another example of a hair brush according to the teachings of the present invention.

FIGS. 13 and 14 show additional examples of water absorbing hairstyling implements 600, 700. The hairstyling implements 600, 700 in these examples employ a water absorbing material of a foam construction. In the example of FIG. 13, the styling implement 600 has a body 602 with a handle 604 connected by a neck 606 to a head 608. The head 608 has thin sheets of water absorbing foam joined to the head in serpentine waves or loops 610. The waves or loops 610 can be joined to the head 608 in spaced apart rows arranged on the head 608. The rows can be spaced longitudinally along a longitudinal axis Z-Z of the body 602 and can each extend laterally across a width of the head 608. The waves or loops 610 can be configured to maximize contact with wet hair during styling. In the present example, the foam waves or loops 610 vary in length and are longer nearer the axis Z-Z of the head 608. The length of each loop can be uniform or can vary relative to other of the loops or rows. The width of each loop is uniform with the others in this example, but can vary and remain within the teachings of the present invention. The hairstyling implement 600 of FIG. 13 also includes a column of comb-like teeth 612 on each of the two longitudinal sides of the head 608. The water absorbent foam material is disposed between the rows of teeth. The teeth 612 can aid in detangling hair while directing strands of hair over the foam loops 610. The teeth 612 can be omitted and yet the styling implement 600 remains within the teachings of the present invention.

FIG. 14 shows one such example of a hairstyling implement. The styling implement 700 of FIG. 14 has a body 702 with a handle 704 connecting at a neck 706 to a head 708. The head 708 has thin sheets of water absorbing foam forming vanes 710 protruding from one surface 712 of the head. The vanes 710 can be joined to the surface 712 on the head 708 in any suitable manner or can extend through slots in the surface 712. The vanes 710 are arranged edge to edge in columns oriented parallel relative to a longitudinal axis W-W of the body 702. Alternatively, the vanes 710 can be oriented in rows laterally across and perpendicular relative to the longitudinal axis W-W of the body 702. The vanes need not be in rows or columns, but instead could be arranged randomly on the surface 712. In another alternative, comb-like teeth could be added to sides of the head or to another position on the head to aid in guiding wet hair over the absorbent vanes. Bristles could also be interspersed among the waves or loops 610 in each of these examples.

Figure 15:
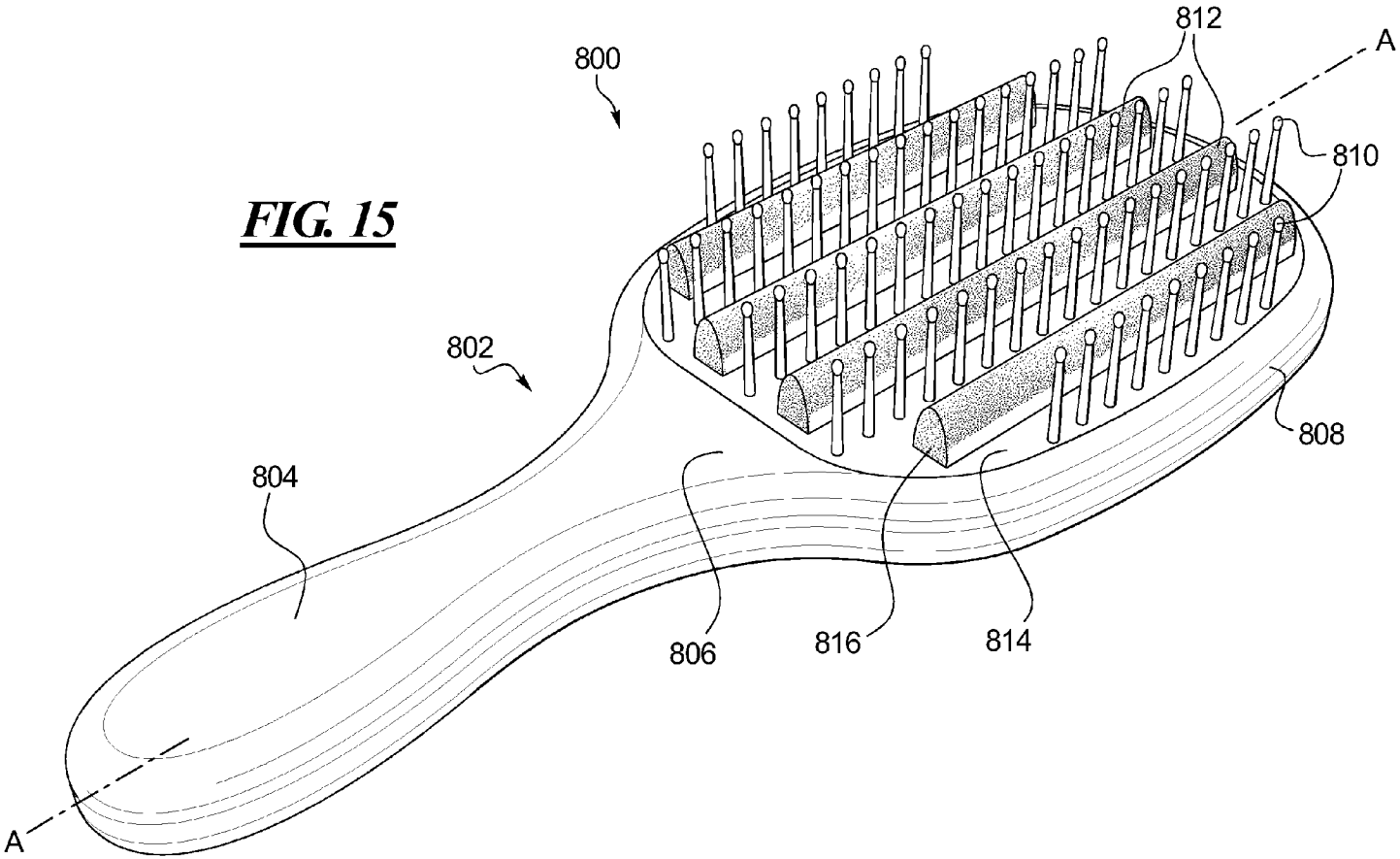
FIG. 15 shows a perspective view of another example of a hair brush according to the teachings of the present invention.
Figure 16:
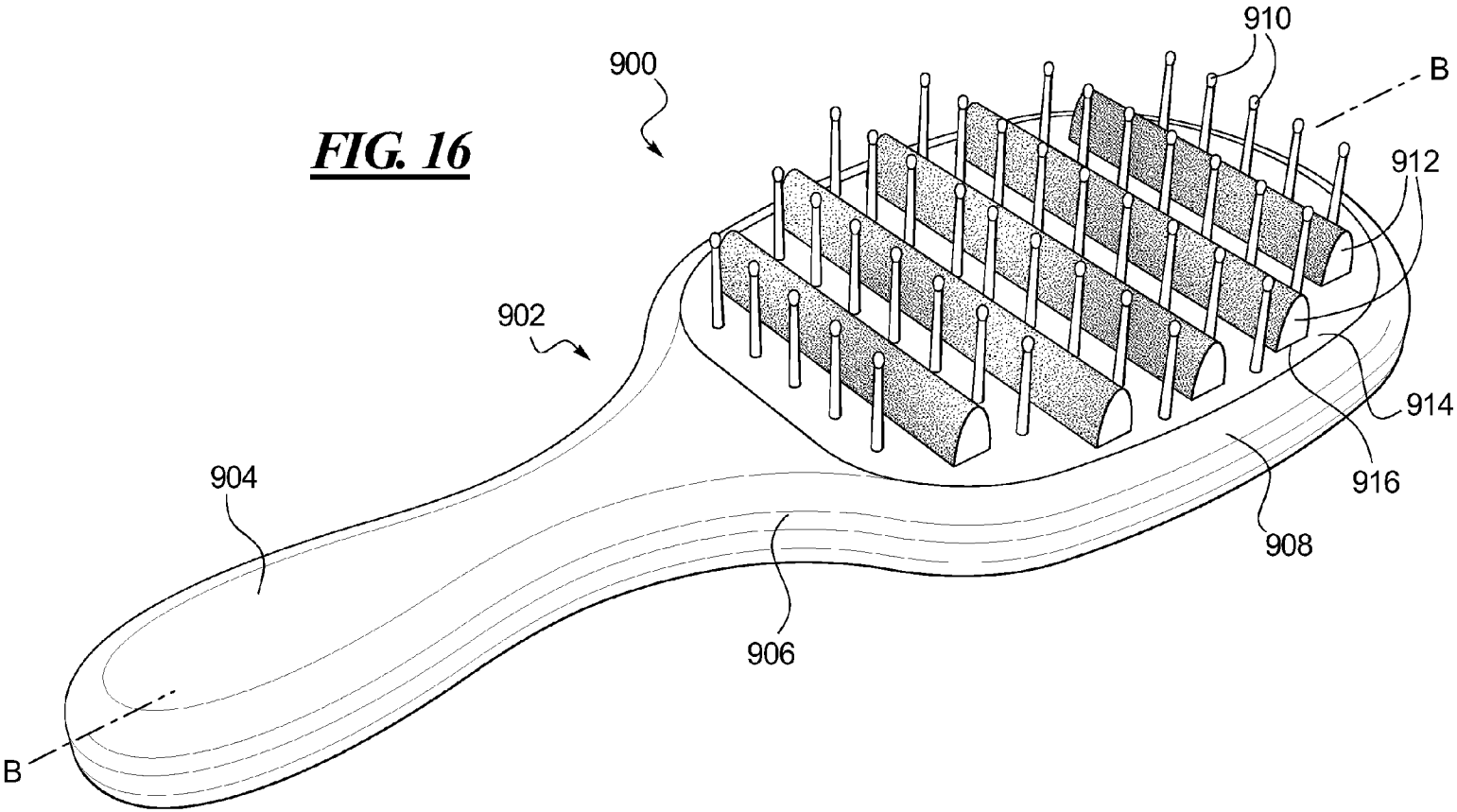
FIG. 16 shows a perspective view of another example of a hair brush according to the teachings of the present invention.

FIGS. 15 and 16 show additional examples of water absorbing hair brushes. In FIG. 15, a hair brush 800 has a body 802 with a handle 804 joined at a neck 806 to a head 808. The head 808 in this example is a somewhat flattened rectangular or oval paddle style head. The head 808 carries a plurality of bristles 810 and a water absorbent material. The water absorbent material is arranged in parallel ridges 812 formed of a foam material such as a small open cell foam. The brush body 802 has a longitudinal axis A-A. The bristles 810 are arranged in columns parallel to the longitudinal axis A-A. The ridges 812 are arranged parallel to and in alternating columns with the columns of bristles 810. The foam ridges 812 can extend substantially the length of the head 808. The absorbent foam ridges 812 can be attached on top of a front surface 814 on the head 808. Alternatively, the front surface 814 of the head 808 can include slots 816 for receiving foam ridges 812 that pass through from a back side of the front surface 814 to protrude outward from the head 808. The ridges 812 can thus be connected to a larger foam base or block (not shown) with a cavity of the head 808. The bristles 810 can be attached to or extend through the front surface of the head 808. The bristles 810 can be mounted individually on the front surface 814. Alternatively, the bristles 810 can be integrally molded with the front surface 814 of the head. The bristles can also be carried on a bristle pad that is the front surface 814 or that is beneath the front surface.

In FIG. 16, a hair brush 900 has a body 902, and a handle 904 joined at a neck 906 to a head 908. The head 908 in this example is a somewhat flattened rectangular or oval paddle style head. The head 908 again carries a plurality of bristles 910 and a water absorbent material. The water absorbent material has ridges 912 of an absorbent foam material. The brush body 902 has a longitudinal axis B-B. The bristles 910 are arranged in rows across the head 908 perpendicular to the longitudinal axis B-B. The absorbent ridges 912 are arranged parallel to and alternating with the rows of bristles 910. The ridges 912 can extend substantially the width of the head. Similar to FIG. 15, the absorbent foam ridges 912 can be attached on top of a front surface 914. Alternatively, the front surface 914 can include slots 916 and the foam ridges 912 can protrude through the slots from a back side of the front surface 914 and outward from the head 908. The bristles 910 can be mounted individually on the front surface 914 or be carried on a base or pad that is separate from or that is the front surface. Alternatively, the bristles can be integrally molded with the front surface of the head.

As with the prior examples, the brush bodies shown in FIGS. 15 and 16 may be constructed from one piece or from two or more pieces. The front face can be formed of the same material as the brush body or a different material such as a relatively more flexible material.

Figure 17:
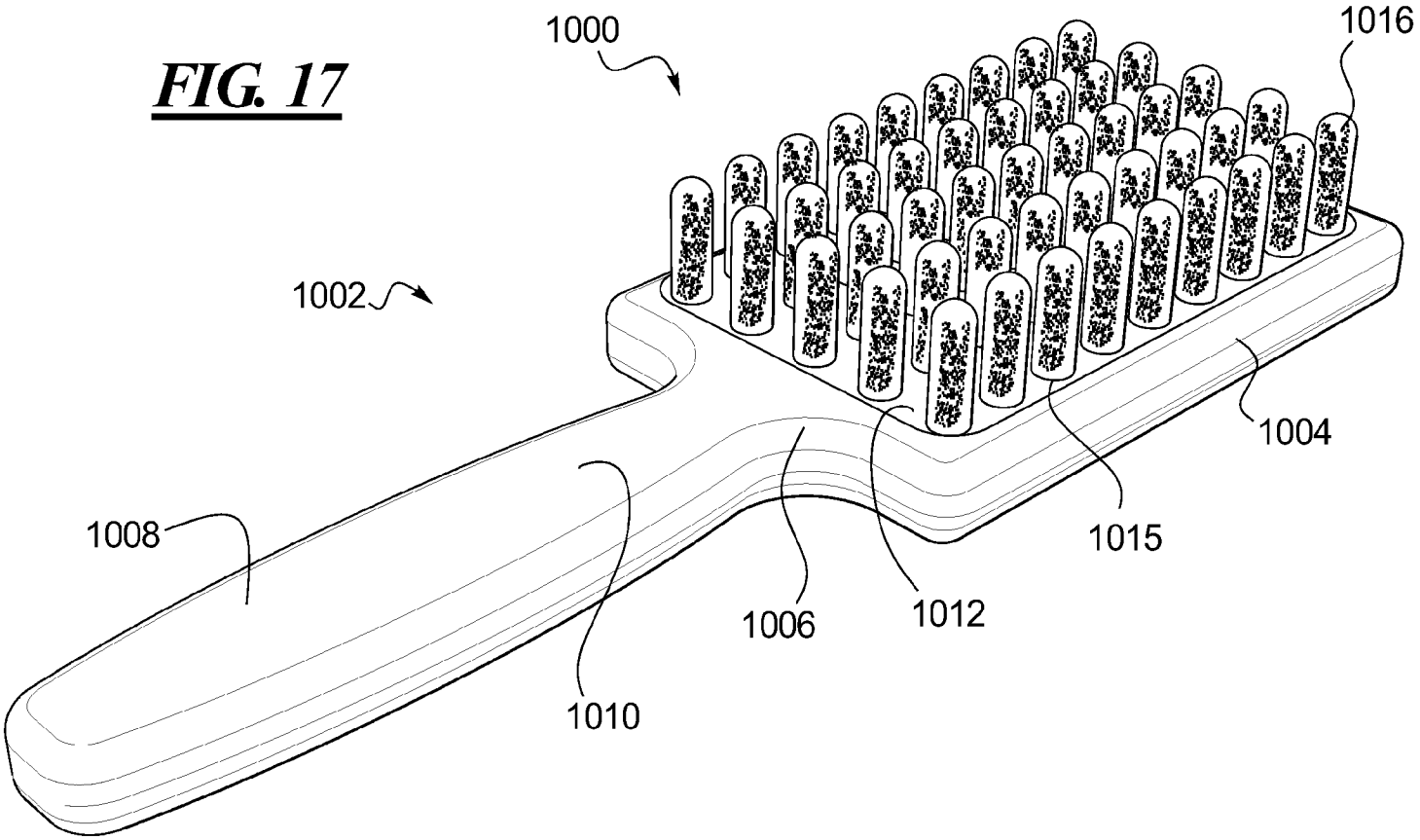
FIG. 17 shows a perspective view of another example of a hair brush according to the teachings of the present invention.
Figure 18:
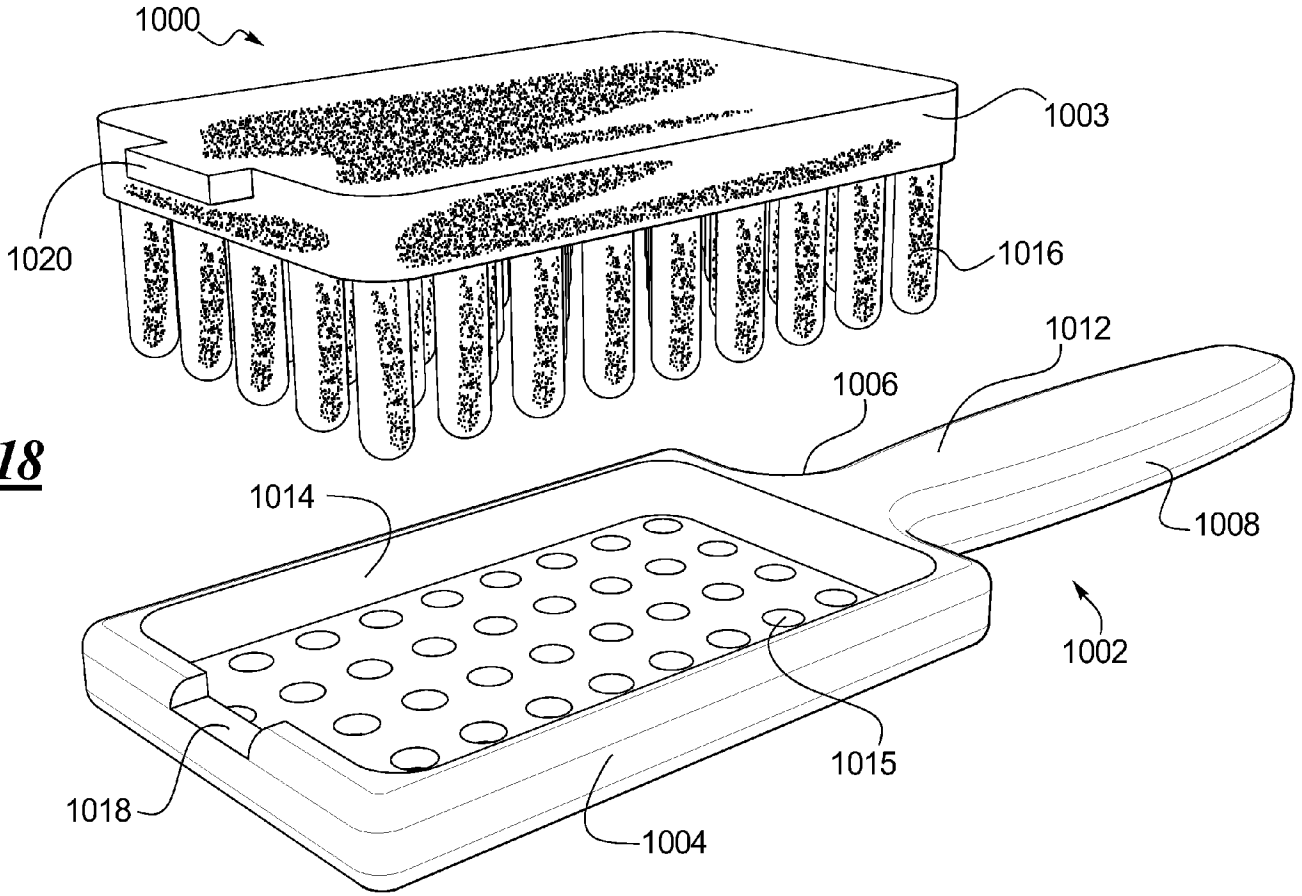
FIG. 18 shows an opposite side perspective view of the hair brush of FIG. 17 in an unassembled condition.

FIGS. 17 and 18 show another example of a water absorbing hair brush according to the teachings of the present invention. A hair brush 1000 includes a body 1002 and a water absorbent material. In this example, the water absorbent material has a foam block 1003. The body 1002 has a head 1004 connected at a neck 1006 to a handle 1008, although a handle may be omitted and remain within the teachings of the present invention. The body 1002 has a front side 1010 as shown in FIG. 17 and a back side 1012 as shown in FIG. 18. The head 1004 of the body 1002 has a recess 1014 formed in the back side 1012. The body 1002 further has perforations 1015 through the back side 1012 to the front side 1010, as shown in FIG. 18, within the recess 1014. The foam block 1003 has foam projections that form oversized or thick bristles 1016. The foam block 1003 is sized to fit snugly or interferingly in the recess 1014. The bristles 1016 are sized and arranged to fit through the perforations 1015 when the block 1003 is placed in the recess 1014 of the head 1004. The bristles 1016 project through the perforations 1015 and protrude outwardly from the front side 1010. Further the back side 1012 of the head 1004 has a rectangular notch 1018 at a top end. The foam block 1003 has a complimentary sized retention tab 1020 protruding from one end. When the foam block 1003 is placed in the recess 1014 on the back side 1012 of the head 1004, the retention tab 1020 seats in the notch 1018 to help retain the foam block 1003 in the recess 1014 and to assist a user in grasping and removing the water absorbent material block 1003 therefrom, as needed. The number, size, location, and arrangement of the notch and retention tab, or means of retention and release, can vary and remain within the teachings of the present invention.

The block 1003 and the bristles 1016 are integrally formed together of a water absorbent material such as a small open cell foam. The foam block 1003 can be integrally formed or molded with the bristles 1016. The foam block 1003 and bristles 1014 can be made of a foam material having sufficient rigidity to permit the bristles to separate and comb through wet hair. The body 1002 of the brush 1000 may be formed of one piece or more than one piece fitted together, as with the other examples described herein. The body can be made of injection molded plastic. The materials and arrangement of the body and the foam block can vary and remain within the teachings of the present invention. The ability to remove the water absorbent material from the body can allow a user to squeeze water from the bristles and block, to allow easy replacement, or both. Having the block 1003 exposed will also greatly aid in evaporation of moisture from the water absorbent material when not being used, even if still retained in the recess.

Figure 20:
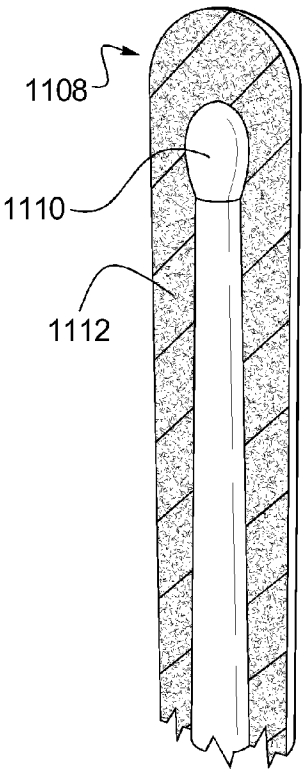
FIG. 20 shows a detail cross section taken along line XX-XX of a bristle portion of the hair brush of FIG. 19.
Figure 19:
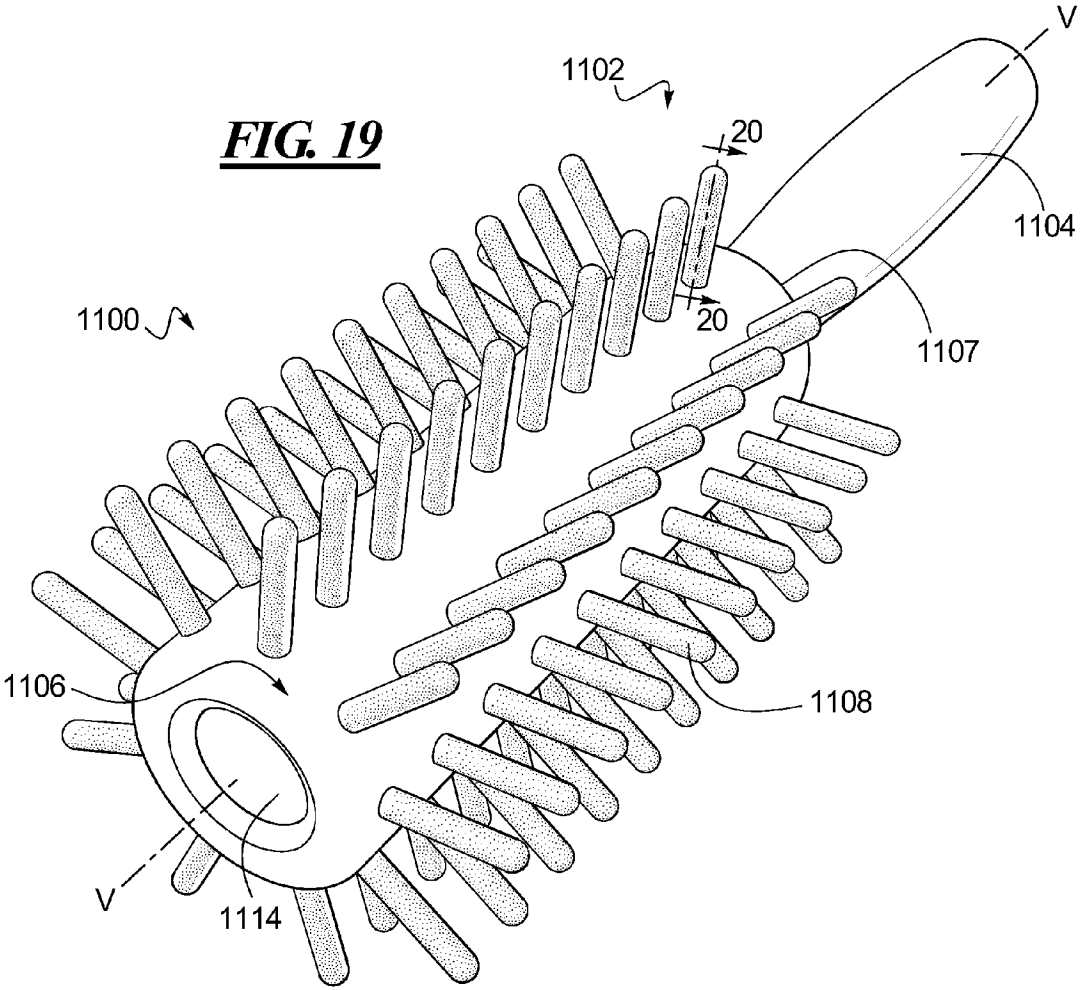
FIG. 19 shows a perspective view of another example of a hair brush according to the teachings of the present invention.

A hair brush 1100 is shown in FIG. 19 and has a body 1102 with a handle 1104 extending from a cylindrical head 1106. The body 1102 has a longitudinal axis V-V. The handle 1104 is joined to the head 1106 at a neck 1107. The cylindrical head 1106 has a plurality of oversized bristles 1108. The bristles 1108 are arranged to extend radially outward relative to the longitudinal axis V-V. The head 1106 can be hollow and can have an open end 1114 opposite the handle end. The bristles 1108 have a center element 1110, as shown in FIG. 20, with a coating 1112 of a water absorbent material. The center element 1110 of the bristles can be made of nylon or of a material with similar qualities for strength and flexibility. The center element 1110 of the bristles 1100 can be coated or encased in the water absorbent material layer 1112 such as a small open cell foam. The bristles can be individually mounted on the head 1106. Alternatively, the water absorbent material layer 1112 can be overmolded onto a plastic or nylon sleeve with integral bristles. The brush can include a cylinder base (not shown) for receiving such a removably replaceable sleeve.

Figure 21:
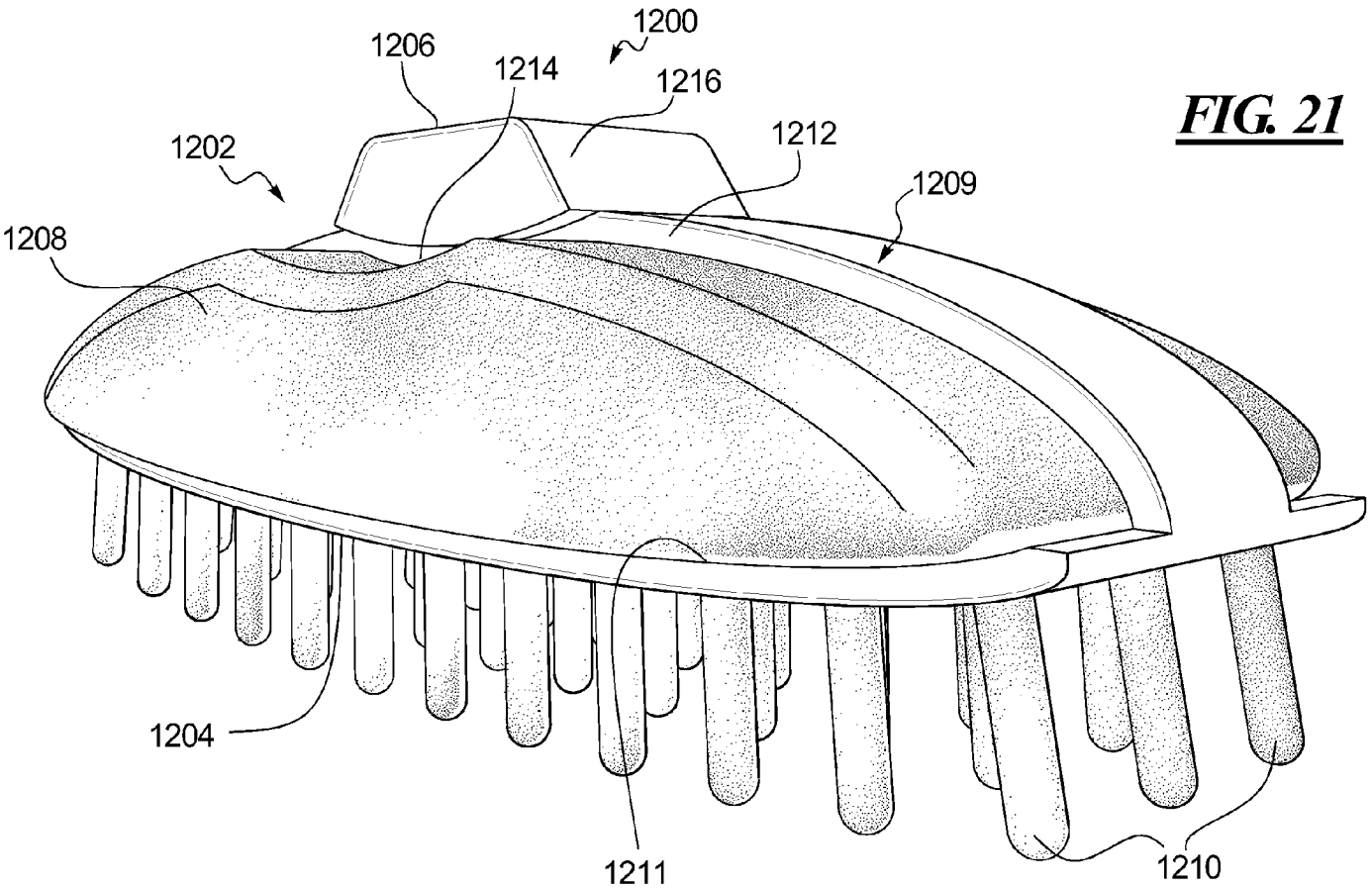
FIG. 21 shows a perspective view of another example of a hair brush according to the teachings of the present invention.

FIG. 21 shows another example of a hair brush 1200 according to the present invention. The hair brush 1200 has a body 1202 with a bristle face 1204 and a gripping face 1206. The body 1202 has an absorbent core or block 1208 and a carrier 1209. The carrier 1209 can be plastic, wood, metal, or the like and has a support plate 1211 against which the core or block 1208 rests. The brush 1200 has no separate handle in this example. A plurality of bristles 1210 are mounted on or protrude through the bristle face 1204. The carrier 1209 has an arc shaped bridge 1212 opposite the bristle face 1204. The bridge 1212 extends between one end of the body 1202 and the opposite end of the body. A midpoint 1214 of the bridge 1212 is spaced apart from a back side of the plate 1211 to create a space to receive the absorbent core 1208. The absorbent core 1208 is captured under the bridge 1212 and on the back side of the plate 1211 opposite the bristle face 1204. The absorbent core 1208 can be formed of a water absorbent foam material. The bridge 1212 can have a grip 1216 disposed at the midpoint 1214 to create a comfortable hold for the user. One end or the other of the bridge 1212 can be releasably attached to one end or the other of the plate 1211 in order to allow the absorbent core to be removable and replaceable within the body 1202. A user can release the bridge 1212 and replace a wet core with a dry core if desired. In one example, the bridge 1212 can be formed of a material that is sufficiently flexible to allow a user to press the bridge 1212 toward the plate 1211 to squeeze the absorbent core 1208 to release water.

The bristles 1210 have a center element (not shown), similar to the previous examples, of a non-absorbent, relatively stiff or rigid material, such as nylon. Each of the center elements is again coated with a water absorbent foam material such as shown in FIG. 20. The foam coating on the bristles 1210 can wick water from the bristles to the absorbent core 1208. The bristle face 1204 can have perforations for attachment of the bristles 1210 with the foam coating and to allow the foam coating on the bristles 1210 to contact the foam core 1208. Such contact between the foam coating and the foam core 1208 permits water absorbed from wet hair during styling by the bristles 1210 to be wicked away to the absorbent foam core 1208. The foam core 1208 can be removable and can be squeezed, whether removed or not, to release water absorbed by the core. The carrier can be constructed so that the core and bristles are formed as one piece with the bristles protruding through perforations (not shown) on the support plate. The open sides of the carrier 1209 allow water to evaporate and dry the absorbent core 1208.

In all of the foregoing examples, the brush bodies may be formed or molded of plastic such as acrylonitrile butadiene styrene (ABS) or a similar material. Bristle materials may include nylon, plastic, natural, stiff animal hair, or other materials. In certain examples, the disclosed bristle pad, support, or substrate may be made of the same material as the bristles or of a different material. Such materials can include plastic material meeting the requisite requirements for a combination of strength and flexibility.

A microfiber fabric according to the present disclosure can include a base layer or substrate and fabric or flexible rods made of polyester 85% and nylon 15%. Other material and chemical combinations may be used if such materials have the desired characteristics described above.

An antimicrobial additive e.g. triclosan may be used with the microfiber fabric and/or the absorbent foam material described above to give the disclosed hair brushes and styling implements antimicrobial properties.

The specific features of any one of the embodiments described herein may be employed on any of the other embodiments where feasible. For example, any of the brush bodies may have a handle or no handle, texture or no texture. Brushes may have a water absorbing material of foam, fabric, or other suitable water absorbing materials. Suitable fabrics may include and are not limited to various fabric types and weaves such as plain weaves, terry cloth, cut or uncut pile weaves, or the like. Any of the hair brushes may include coated bristles, separate bristles, integrally molded bristles, and/or absorbent rods, etc., and remain within the teachings of the present invention.

Materials and combinations of materials used for the brushes described herein can vary. For example, decorative features may be used on a brush body such as decorative gripping surfaces with or without texture, combinations of materials such as wood and plastic, or overmolded plastics or other materials. Such materials may be made in complimentary or contrasting colors and/or textures, or combinations, and be used on any of the hair brushes described herein and remain with the teachings of the present invention.

Although certain hairstyling implements have been described herein in accordance with the teachings of the present disclosure, the scope of coverage of this patent is not limited thereto. On the contrary, this patent covers all examples of the teachings of the disclosure that fairly fall within the scope of permissible equivalents.

What is claimed is:

1. A hair brush comprising:

a body having a head;

a plurality of bristles carried by the head, the plurality of bristles protruding relative to the head; and a microfiber fabric material carried by part of the body, the microfiber fabric material being water absorbent and a portion of the microfiber fabric material positioned near the plurality of bristles.

2. The hair brush according to claim 1, further comprising:
a cavity within a portion of the head; and
one or more vents in communication with the cavity.

3. The hair brush according to claim 1, wherein the microfiber fabric material has a base substrate carried by the head and a plurality of fabric rods interspersed among the plurality of bristles.

4. A hair brush comprising:
a body having a head;
a plurality of bristles carried by the head, the plurality of bristles protruding relative to the head;
a microfiber fabric material having a base substrate carried by the head and a plurality of fabric rods interspersed among the plurality of bristles, the microfiber fabric material being water absorbent; and
a cavity within the head wherein the base substrate is located at least in part within the cavity.

5. The hair brush according to claim 4, further comprising one or more air vents in communication with the cavity.

6. The hair brush according to claim 1, wherein the body has a handle coupled to the head and wherein the microfiber fabric material is carried by the head.

7. The hair brush according to claim 1, wherein the head is generally rectangular in shape or oval in shape.

8. The hair brush according to claim 1, wherein at least a portion of the head is a cylinder shape or partial cylinder shape and the plurality of bristles protrude in a radial direction relative to an axis of the head.

9. The hair brush according to claim 1, wherein the plurality of bristles extend from a bristle pad that is carried by the head.

10. The hair brush according to claim 9, wherein the bristle pad is a panel substrate and has a plurality of perforations formed therethrough and wherein each of the plurality of bristles protrudes from a surface of the panel substrate and is interspersed among the perforations.

11. The hair brush according to claim 9, wherein the microfiber fabric material has a base substrate layer that lies against a surface of the bristle pad and wherein the plurality of bristles protrudes through the microfiber fabric material.

12. The hair brush according to claim 1, wherein the microfiber fabric material has a plurality of flexible fabric rods that are interspersed among the plurality of bristles and wherein each of the plurality of flexible fabric rods is oriented extending generally in the same direction as adjacent ones of the plurality of bristles.

13. The hairbrush according to claim 12, wherein the plurality of bristles is arranged in rows and columns on the head and wherein the plurality of flexible fabric rods is arranged in rows and columns of a spacing that generally matches a spacing of the rows and columns of the plurality of bristles.

14. The hair brush according to claim 1, wherein the microfiber fabric material has antibacterial properties.

15. The hair brush according to claim 1, wherein the microfiber fabric material has an exposed surface texture that is a heat stamped pattern on the exposed surface or is a sewn quilted pattern on the exposed surface or is formed of relatively narrow strips of microfiber fabric woven together.

16. The hairbrush according to claim 1, wherein the microfiber fabric material has a base substrate that overlies a bristle pad from which the plurality of bristles extends and wherein the plurality of bristles protrudes through the microfiber fabric material.

17. The hair brush according to claim 1, wherein the head has a surface that forms a cylinder or a partial cylinder, wherein the body has a handle extending in an axial direction from an end of the head, and wherein the plurality of bristles protrude radially outward from the surface.

18. The hair brush according to claim 17, wherein the microfiber fabric material is disposed on the surface.

19. A hair brush comprising:
a body having a head;
a plurality of bristles carried by the head, the plurality of bristles protruding relative to a surface of the head; and
a fabric material carried at least in part by the head, the fabric material being water absorbent and including a layer of the fabric material carried on the head and a protruding portion of the fabric material protruding from and connected to the layer and interspersed among the plurality of bristles.

20. The hair brush according to claim 19, wherein the fabric material is a microfiber fabric.

21. The hair brush according to claim 19, wherein the protruding portion of the fabric material has a plurality of fabric rods that are oriented in generally the same direction as the plurality of bristles and interspersed among the plurality of bristles.

* * * * *